US008565647B2

(12) United States Patent
Shigemura et al.

(10) Patent No.: US 8,565,647 B2
(45) Date of Patent: Oct. 22, 2013

(54) IMAGE FORMING APPARATUS

(75) Inventors: Yoshihiro Shigemura, Yokohama (JP); Yuri Mizutani, Kawasaki (JP); Ichiro Okumura, Abiko (JP); Jiro Shirakata, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 262 days.

(21) Appl. No.: 13/177,978

(22) Filed: Jul. 7, 2011

(65) Prior Publication Data

US 2012/0008995 A1 Jan. 12, 2012

(30) Foreign Application Priority Data

Jul. 8, 2010 (JP) ..... 2010-155743

(51) Int. Cl.
*G03G 15/00* (2006.01)

(52) U.S. Cl.
USPC ..... 399/167; 399/36; 399/38

(58) Field of Classification Search
USPC ..... 399/36, 68, 167
See application file for complete search history.

(56) References Cited

U.S. PATENT DOCUMENTS

| | | | | |
|---|---|---|---|---|
| 6,185,402 | B1 | 2/2001 | Linssen | |
| 2008/0131168 | A1* | 6/2008 | Ehara et al. | 399/167 |
| 2009/0123197 | A1 | 5/2009 | Okumura et al. | |
| 2010/0142984 | A1 | 6/2010 | Okumura et al. | |
| 2011/0097095 | A1 | 4/2011 | Shirakata | |
| 2012/0107024 | A1* | 5/2012 | Shimizu et al. | 399/301 |

FOREIGN PATENT DOCUMENTS

| | | | |
|---|---|---|---|
| JP | 10-39571 | A | 2/1998 |
| JP | 10-293435 | A | 11/1998 |
| JP | 2003-161645 | A | 6/2003 |
| JP | 2004-279823 | A | 10/2004 |
| JP | 2009-134264 | A | 6/2009 |
| JP | 2010-60761 | A | 3/2010 |

* cited by examiner

*Primary Examiner* — Walter L Lindsay, Jr.
*Assistant Examiner* — Roy Y Yi
(74) *Attorney, Agent, or Firm* — Fitzpatrick, Cella, Harper & Scinto

(57) ABSTRACT

A first and second electrostatic image code is located outside a developing zone. A transfer belt provided with an electrostatic image recording track capable to transfer the electrostatic code between the first drum and second drum. A transferring voltage applies to a side of the transfer belt for the first drum to transfer the first electrostatic image code onto the electrostatic image recording track. An electroconductive member is in parallel with the electrostatic image code and a surface of the electrostatic image code detected within a predetermined gap. An induced current generated in the electroconductive member relative to the lines of the electrostatic image codes which control the first drum or the second drum on the basis of a detection result of the detecting means such that the toner image on the second drum transferred onto a recording material on the transfer belt and overlaid on the toner image transferred onto the recording material from the first drum.

16 Claims, 29 Drawing Sheets

IMAGE FORMING APPARATUS

FIELD OF THE INVENTION AND RELATED ART

The present invention relates to an image forming apparatus in which a toner image on an image bearing member is aligned dynamically relative to a toner image carried on an intermediary transfer member or the like, more particularly to a structure in which codes of an electrostatic image formed on the image bearing member is transferred onto an intermediary transfer member and is used for alignment of the toner images.

An image forming apparatus in which relative to a toner image transferred onto the intermediary transfer member from a first image bearing member which is in an upstream side, a toner image formed on a second image bearing member which is in a downstream side is superimposedly transferred is widely used. In an image forming apparatus using an intermediary transfer member, it is desirable that the toner image formed on the second image bearing member is aligned precisely with the toner image transferred onto the intermediary transfer member in such an order as the scanning lines with respect to a sheet feeding direction.

In addition, an image forming apparatus in which relative to a toner image transferred onto the recording material carried on a recording material feeding member from a first image bearing member which is in an upstream side, a toner image formed on a second image bearing member which is in a downstream side is superimposedly transferred is also widely used. In an image forming apparatus using an intermediary transfer member, it is desirable that the toner image formed on the second image bearing member is aligned precisely with the toner image transferred onto the recording material carried on the recording material feeding member in such an order as the scanning lines with respect to a recording material feeding direction.

Japanese Laid-open Patent Application Hei 10-39571 discloses that the recording material feeding member is provided with a high resistance electrostatic image recording track in order to adjust start timing of the image exposure between the first image bearing member and the second image bearing member during non-image-formation. A rectangular electrostatic image formed by image exposure on the first image bearing member is transferred onto the electrostatic image recording track to feed it to a transfer portion for the second image bearing member, and a drum current is detected in a state that it is overlaid on a rectangular electrostatic image formed by image exposure on the second image bearing member. Then, the start timing of the exposure for the formation of the rectangular electrostatic image on the second image bearing member is changed, and the drum current at this time is detected, and the start timing of the image exposure of the second image bearing member is set so that the drum current is minimum.

In Japanese Laid-open Patent Application 2004-279823, the first rectangular electrostatic image formed on the first image bearing member and the second rectangular electrostatic image formed on the second image bearing member are detected by a potential sensor on the recording material feeding member during non-image-formation periods. The start timing of the image exposure for the second image bearing member is set so as to offset the deviation between the detection timing of the first rectangular electrostatic image and the detection timing of the second rectangular electrostatic image.

In the toner image alignment control disclosed in Japanese Laid-open Patent Application Hei 10-39571 and 2004-279823, the image forming operation is periodically is interrupted to correct the start timing of the image exposures of the first image bearing member and the second image bearing member. Therefore, the toner image alignment errors which result from a temperature change and change of the apparatus with time, which errors are normal and predictable as tendencies can be corrected, but the toner image alignment error attributable to the speed variation of the recording material feeding member which occurs periodically or isolatedly cannot be corrected.

On the other hand, a proposal has been made in which an ink incremental pattern is formed on a recording material feeding member or intermediary transfer member using magnetic recording or optical recording, and the incremental pattern is detected adjacent to the second image bearing member to dynamically align the toner images.

In Japanese Laid-open Patent Application Hei 10-293435, a result of the detection of the incremental pattern magnetically recorded on the recording material feeding member is fed back for the control of a rotational speed and a rotational phase of the second image bearing member. By this, the periodical or incidental speed variation of the recording material feeding member during image forming operation is accommodated In Japanese Laid-open Patent Application 2009-134264, the magnetic recording is effected on the first image bearing member for each scanning line of the image exposure to form the incremental pattern, and the incremental pattern of the first image bearing member is transferred onto the intermediary transfer member. The rotational speed or the like of the image bearing member is adjusted substantially in real time so as to offset the phase difference between the incremental pattern of the intermediary transfer member detected in the transfer portion of the second image bearing member and the incremental pattern of the second image bearing member.

Japanese Laid-open Patent Application 2010-60761 discloses an antenna type potential sensor capable of detecting an edge profile of the electrostatic image formed on the photosensitive drum. The antenna type potential sensor includes an electroconductive member extending in parallel with a scanning line and disposed with a predetermined gap from an electrostatic image detection surface to detect an induced current generated in the electroconductive member with relative movement relative to the electrostatic image.

In the alignment control in which the incremental pattern proposed in Japanese Laid-open Patent Application 2009-134264 is transferred, it has been proposed that an electrostatic image recording track is provided in the intermediary transfer member, and the electrostatic image is transferred onto the intermediary transfer member from the first image bearing member. As will be described hereinafter, it is unnecessary to provide a magnetic recording track in the image bearing member and/or the intermediary transfer member, and the incremental pattern corresponding with high precision to the writing positions of the scanning line can be formed directly.

In the forming method and the transfer method disclosed in Japanese Laid-open Patent Application Hei 10-39571 and Japanese Laid-open Patent Application 2004-279823, it is not possible to form an electrostatic image such a fine pattern as is comparable to the scanning line level and transfer it to the intermediary transfer member precisely.

Even if such a fine pattern can be formed on the intermediary transfer member, the potential sensor disclosed in Japanese Laid-open Patent Application Hei 10-39571 or Japanese Laid-open Patent Application 2004-279823 cannot detect such an electrostatic image. Further, even if it can be detected, the potential sensors disclosed in Japanese Laid-open Patent Application 2004-279823 or Japanese Laid-open Patent Application Hei 10-39571, the position of the electrostatic image cannot be detected with such a high precision as to permit alignment with the resolution of the scanning lines.

In recent downsized image forming apparatus, it is difficult to place the potential sensor shown in Japanese Laid-open Patent Application Hei 10-39571 and 2004-279823 adjacent to the image forming apparatus.

SUMMARY OF THE INVENTION

Accordingly, it is an object of the present invention to provide an image forming apparatus in which toner images can be superimposed with high precision on an intermediary transfer member or on a recording material carried on a recording material feeding member.

According to an aspect of the present invention, there is provided an image forming apparatus comprising a first image bearing member; first code forming means for forming a first electrostatic image code outside a developing zone for a toner image; a second image bearing member; second code forming means for forming a second electrostatic image code outside the developing zone for the toner image; an intermediary transfer member provided with an electrostatic image recording track capable of holding the first electrostatic image code transferred from said first image bearing member to said second image bearing member; transferring means for applying a voltage to a side of said intermediary transfer member which is opposite a side contactable to said first image bearing member to transfer the first electrostatic image code onto said electrostatic image recording track; detecting means including an electroconductive member provided which is parallel with said electrostatic image code and which is spaced from a surface of said electrostatic image code of the said electrostatic image recording track to be detected with a predetermined gap, and a detecting portion for detecting an induced current generated in said electroconductive member with relative movement relative to the lines of said electrostatic image code, said detecting means detecting said first electrostatic image code of the said electrostatic image recording track and said second electrostatic image code of the said second image bearing member at a position of the said second image bearing member; and control means for controlling image formation on said first image bearing member or said second image bearing member on the basis of a detection result of the said detecting means such that the toner image on said second image bearing member is transferred onto said intermediary transfer member and overlaid on the toner image transferred onto said intermediary transfer member from said first image bearing member.

These and other objects, features, and advantages of the present invention will become more apparent upon consideration of the following DESCRIPTION OF THE PREFERRED EMBODIMENTS of the present invention, taken in conjunction with the accompanying drawings.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention are described in detail with reference to the appended drawings. The present invention is also applicable to an image forming apparatus which is partially or entirely different in structure from those in the following preferred embodiments, as long as the image forming apparatus to which the present invention is applied is structured so that electrostatic codes (scales) which are for aligning toner images, and the pitch of which corresponds to the pitch of the scanning lines for image formation, are transferred from the first image bearing member of the apparatus onto an electrostatic image recording track. Incidentally, these electrostatic codes for aligning toner images are referred to simply as electrostatic alignment codes.

In other words, the present invention is indiscriminately applicable to any image forming apparatus having multiple image bearing members, regardless of image bearing member count, how each image bearing member is charged, how an electrostatic latent image is formed, what kind of developer is used, how an electrostatic latent image is developed, how a developed image is transferred (first transfer) from an image bearing member to an intermediary transfer member, how a developed image is transferred (second transfer) from an intermediary transferring member to a final recording medium, and the like variables.

<Image Forming Apparatus>

Figure 1:
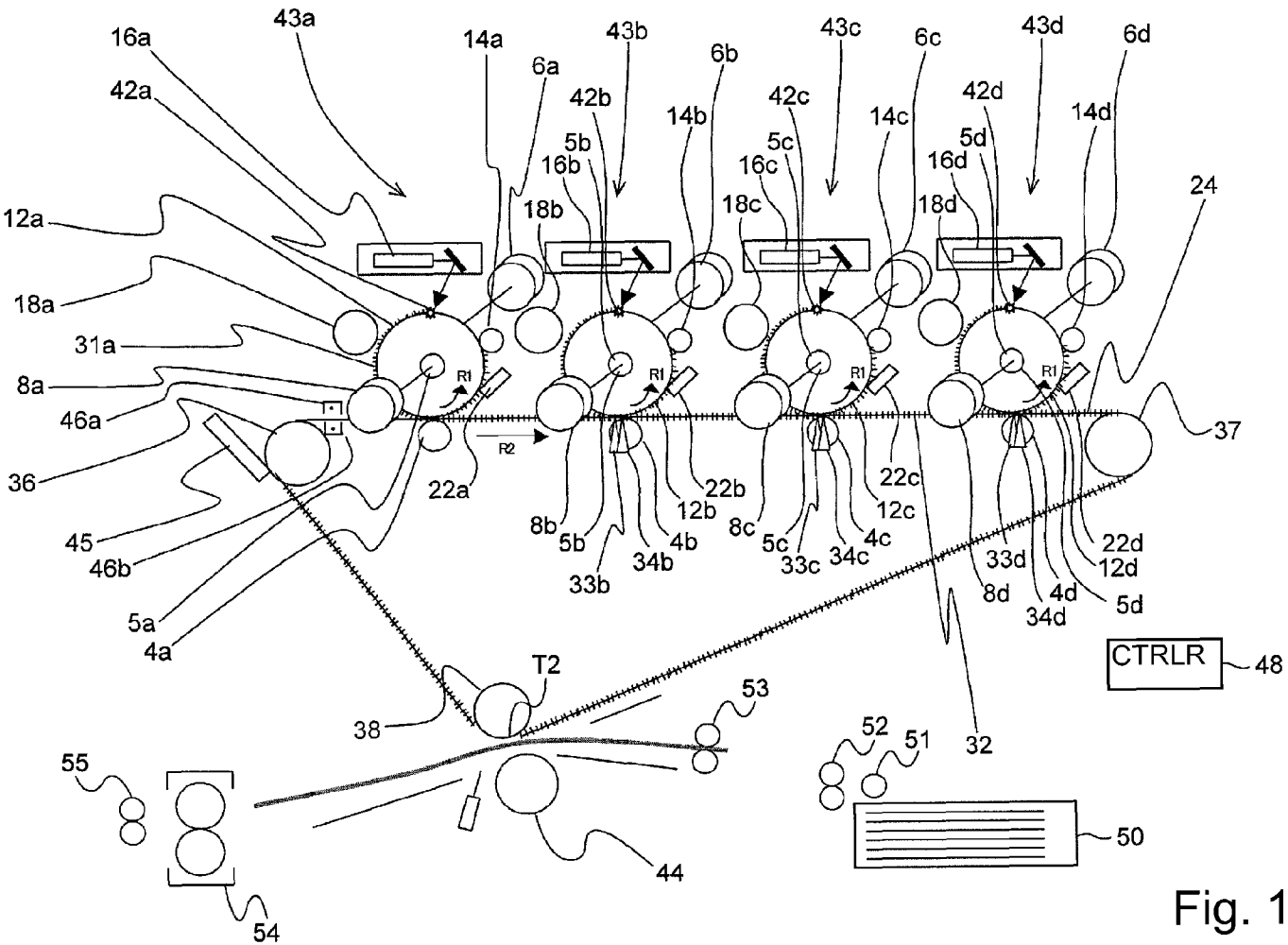
FIG. 1 is an illustration of a general arrangement of an image forming apparatus according to Embodiment 1 of the present invention.
Figure 2:
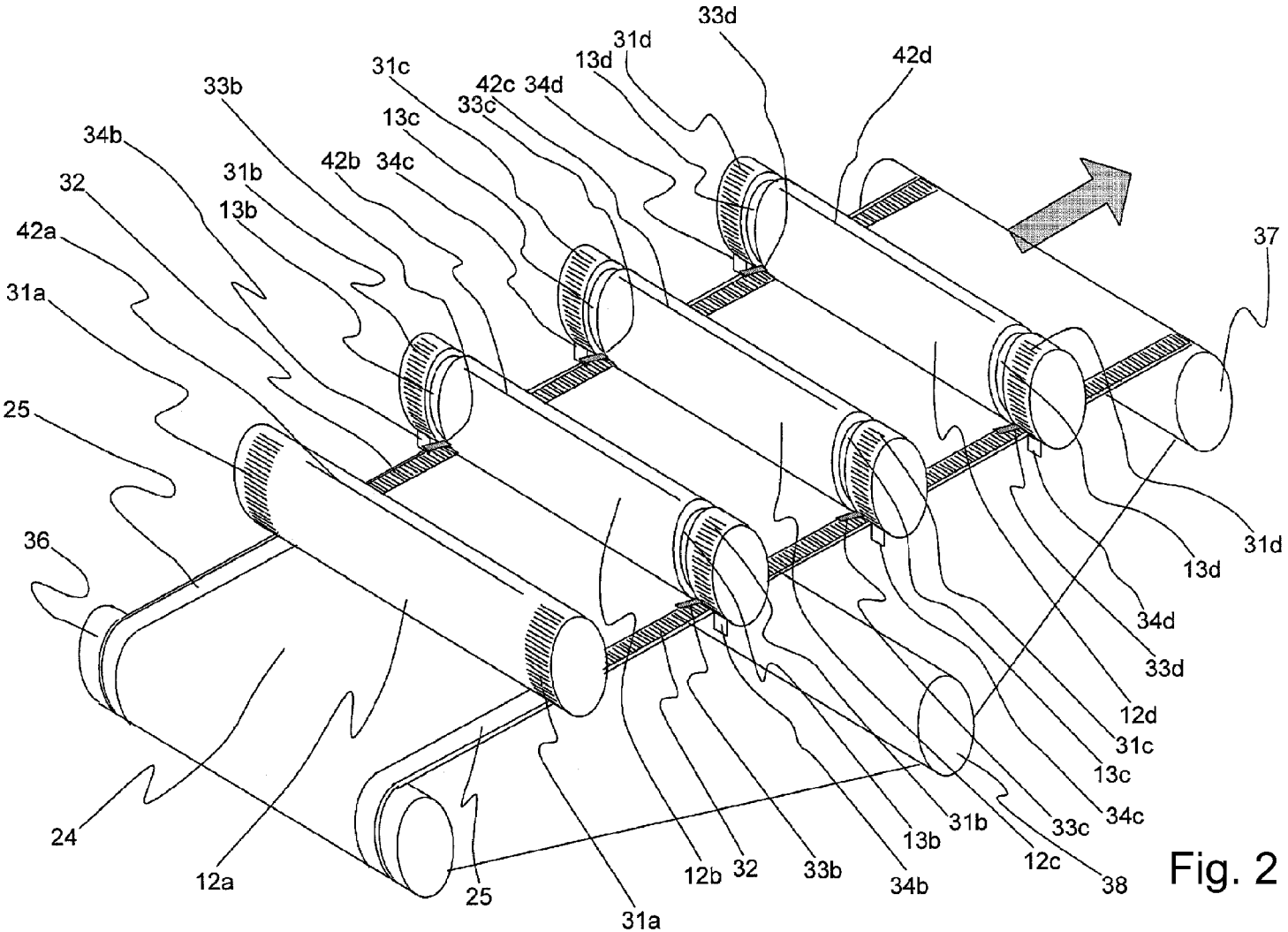
FIG. 2 is an illustration of an electrostatic image recording track and a potential sensor arrangement.
Figure 3:
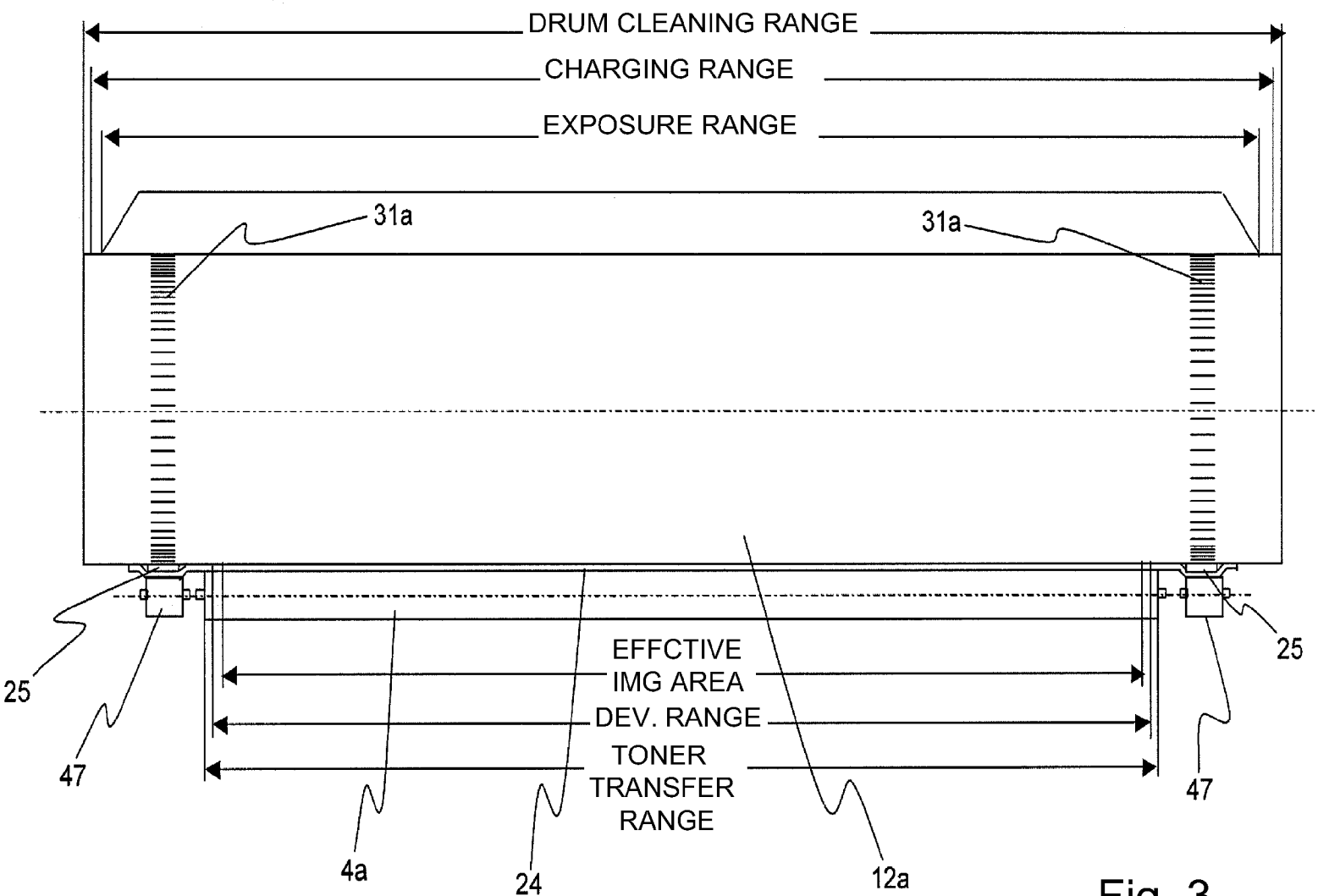
FIG. 3 is an illustration of a transfer portion for an electrostatic image code (scale).
Figure 4:
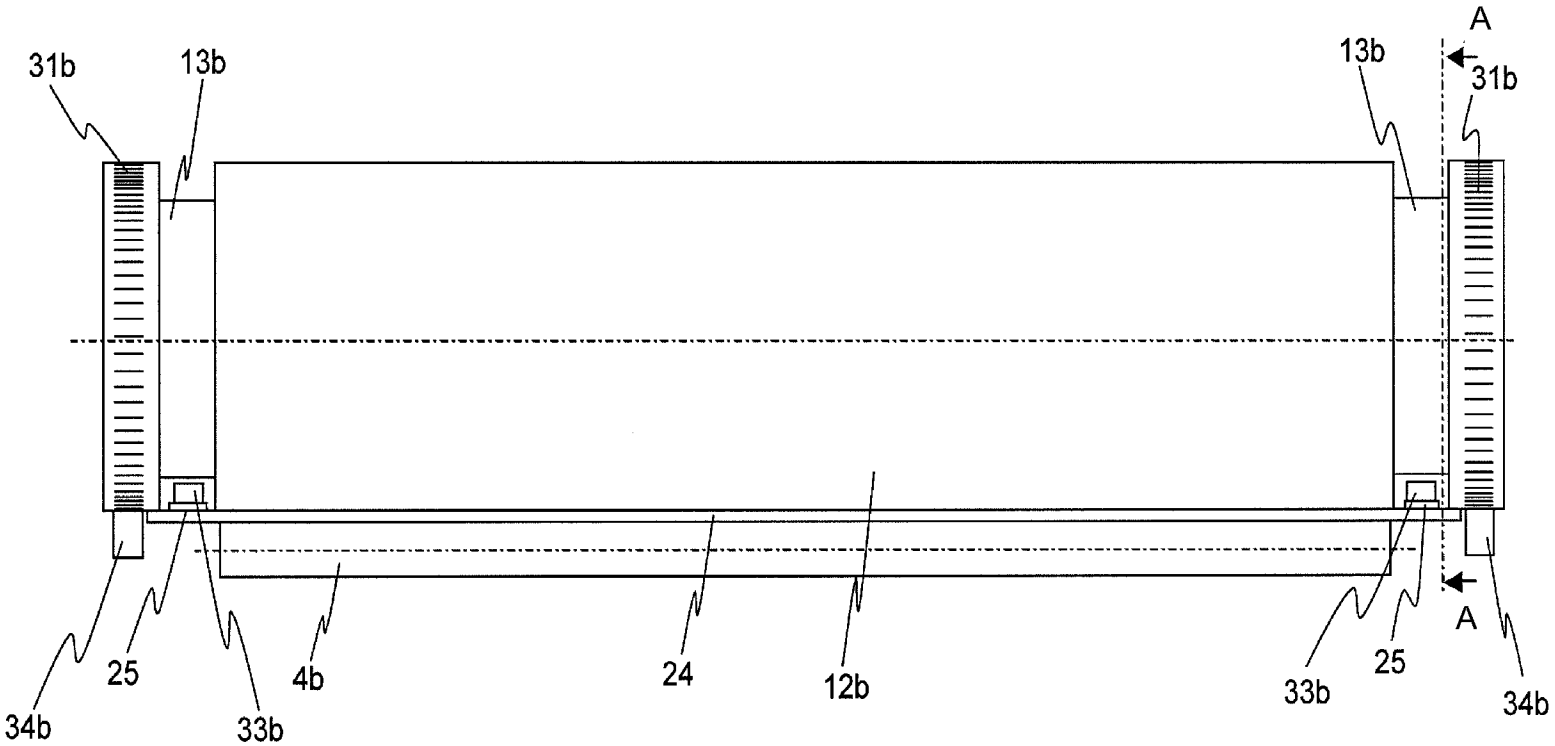
FIG. 4 is an illustration of detecting aligning portion of the electrostatic image code.

FIG. 1 is a schematic sectional view of the image forming apparatus in the first preferred embodiment of the present invention. It shows the general structure of the apparatus. FIG. 2 is a drawing for describing the positioning of the electrostatic image recording track and potential sensor of the apparatus. FIG. 3 is a drawing for describing the electrostatic alignment code transferring area of the apparatus. FIG. 4 is a drawing for describing the portion of the apparatus, which detects and aligns the electrostatic alignment codes.

Referring to FIG. 1, the image forming apparatus 1 is a full-color printer of the tandem type, and also, of the intermediary transfer type. More specifically, the image forming apparatus 1 has four image forming stations 43, that is, yellow, magenta, cyan, and black image forming stations 43*a*, 43*b*, 43*c*, and 43*d*, respectively. The four image forming stations 43 are in the immediate adjacencies of the intermediary transfer belt 24 of the apparatus 1, and are in alignment with each other in the direction parallel to the moving direction of the belt 24.

In the image forming station 43*a*, a yellow toner image is formed on a photosensitive drum 12*a*, and is transferred onto the intermediary transfer belt 24. In the image forming station 43*b*, a magenta toner image is formed on a photosensitive drum 12*b*, and is transferred onto the intermediary transfer belt 24. In the image forming stations 43*c* and 43*d*, cyan and black toner images are formed on photosensitive drums 12*c* and 12*d*, respectively, and are transferred onto the intermediary transfer belt 24. After being transferred onto the intermediary transfer belt 24, the four toner images, different in color, are conveyed to a second transfer station T2, and then, are transferred (second transfer) onto a sheet P of recording medium in the second transfer station T2.

A recording medium cassette 50 contains multiple sheets P of recording medium. Each sheet P of recording medium in the cassette 50 is pulled out of the cassette 50 by a pickup roller 51 while being separated by a pair of separation rollers 52 from the rest, and then, is conveyed to a pair of registration rollers 53. Then, the sheet P is sent by the pair of registration rollers 53 to the second transfer station T2 with such a timing that it enters the second transfer station T2 at the same time as the entrance of the toner images on the intermediary transfer belt 24, into the second transfer station T2.

Then, the sheet P of recording medium is conveyed with the portion of the intermediary transfer belt 24, on which the toner images are, through the second transfer station T2 by the intermediary transfer belt 24 while remaining pinched, along with the intermediary transfer belt 24, by a second transfer roller 44 and a belt backing roller 33. While the sheet P is conveyed through the second transfer station T2, a preset positive voltage is applied to the second transfer roller 44, whereby the layered four monochromatic toner images, different in color, (which make up multicolor toner image), on the intermediary transfer belt 24 are transferred (second transfer) onto the sheet P of recording medium. After the transfer of the toner images onto the sheet P of recording medium, the sheet P is conveyed to a fixing device 54. In the fixing device 54, the sheet P and the toner images thereon, are subjected to heat and pressure, whereby the toner images are fixed to the sheet P. Then, the sheet P is discharged out of the main assembly of the image forming apparatus 1 by a pair of discharge rollers 55.

The image forming stations 43*a*, 43*b*, 43*c*, and 43*d* are roughly the same in structure, although they are different in the color of the developer used by their developing apparatuses 18*a*, 18*b*, 18*c*, and 18*d*. Next, the image forming station 43*a* is described. As for the image forming station 43*b*, 43*c*, and 43*d*, their descriptions are the same as the description of the image forming station 43*a* except for the suffixes b, c, and d, which replace the suffix "a" of the referential codes of the structural components of the image forming station 43*a*, for the identification of the image forming station 43 to which the structural components belong.

The image forming station 43*a* has a photosensitive drum 12*a*, which is an example of the first image bearing member. The image forming station 43*a* has also a charge roller 14*a*, an exposing device 16*a*, a developing device 18*a*, a first transfer roller 4*a*, and a drum cleaning device 22*a*, which are in the adjacencies of the peripheral surface of the photosensitive drum 12*a*.

The photosensitive drum 12*a* is made up of an aluminum cylinder and a photosensitive layer. The aluminum cylinder is 84 mm in diameter. The photosensitive layer covers the virtually entirety of the peripheral surface of the aluminum cylinder, and is negatively chargeable. It is 30 μm in thickness, and is formed of OPC. The photosensitive drum 12*a* is rotated in the direction indicated by an arrow mark R1 at a preset process speed by the driving force transmitted to the photosensitive drum 12*a* from a drum driving motor 6*a*. More specifically, the drum driving force is transmitted to the shaft 5*a* of the photosensitive drum 12*a* from the motor 6*a* through a drive train for transmitting the drum driving force to the shaft 5*a* of the photosensitive drum 12*a*. The drum driving motor 6*a* is in the rear end portion of the main assembly of the image forming apparatus 1. Further, the photosensitive drum 12*a* is provided with a drum encoder 8*a*, which is a rotary encoder and is in connection to the front end of the shaft 5*a* of the photosensitive drum 12*a* through an unshown coupling. The photosensitive drum 12*a* is rotated at a preset angular velocity by the drum driving motor 6*a* which is driven in response to the output signals from the drum encoder 8*a*.

The charge roller 14*a* uniformly charges the peripheral surface of the photosensitive drum 12*a* to a preset negative potential level VD (−600 V), which hereafter may be referred to as dark point potential level. The exposing device 16*a* writes an electrostatic latent image on the uniformly charged portion of the peripheral surface of the photosensitive drum 12*a*. More specifically, it scans the uniformly charged portion of the peripheral surface of the photosensitive drum 12*a* with a beam of laser light which it projects while modulating the beam with the information of the image to be formed. As a given point of the uniformly charged portion of the peripheral surface of the photosensitive drum 12*a* is exposed to the beam, this point is reduced in potential to VL (−100 V). Consequently, an electrostatic image is effected on the peripheral surface of the photosensitive drum 12*a*.

The developing device 18*a* develops the electrostatic image on the peripheral surface of the photosensitive drum 12*a* into a visible image, that is, an image formed of toner, with the use of two-component developer made up of toner and carrier. More specifically, the developing devices 18*a* adheres negatively charged yellow toner to the points of the uniformly charged portion of the peripheral surface of the photosensitive drum 12*a*, which have just reduced in surface potential due to their exposure to the beam of laser light. Consequently, a visible image, that is, a yellow toner image, is effected on the peripheral surface of the photosensitive drum 12*a*.

The first transfer roller 4*a* is roughly 16 mm in diameter. It is made up of an electrically conductive shaft and an electrically conductive surface layer. The surface layer is formed of electrically conductive sponge. The first transfer roller 4*a* is pressed upon the inward surface (in terms of loop which intermediary transfer belt 24 forms) of the intermediary transfer belt 24, forming thereby the first transfer area between the photosensitive drum 12*a* and intermediary transfer belt 24. The negatively charged toner image on the photosensitive drum 12*a* is transferred (first transfer) onto the intermediary transfer belt 24 by the application of a preset positive DC voltage (+1,000 V) to the first transfer roller 4*a*.

The intermediary transfer belt 24 is suspended and kept stretched by a tension roller 37, a belt driving roller 36, and the belt backing roller 38, so that the intermediary transfer belt 24 is provided with a preset amount of tension. The belt driving roller 36 is rotated by an unshown belt driving motor, whereby it moves the intermediary transfer belt 24 in the direction indicated by an arrow mark R2 at a preset process speed. The intermediary transfer belt 24 is an endless belt. It is formed of a resinous substance such as polyimide, PET, PVDF.

The drum cleaning device 22*a* is provided with a cleaning blade which is kept in contact with the outward surface of the intermediary transfer belt 24, at a point where the intermediary transfer belt 24 is supported by the belt driving roller 36. It recovers the transfer residual toner by rubbing the peripheral surface of the photosensitive drum 12*a* with its cleaning blade. Incidentally, in the case of the intermediary transfer belt 24, the residual toner is the toner which is remaining adhered to the intermediary transfer belt 24 on the downstream side of the second transfer station T2.

There are a pair of charge removal brushes at the lengthwise ends of the belt cleaning device 45. Each charge removal brush removes electric charge from the corresponding electrostatic image recording track of the intermediary transfer belt 24 by rubbing the track 25. It is electrically conductive and is grounded. More concretely, electrostatic alignment code 31*a* for toner image alignment are formed on the photosensitive drum 12*a*, and transferred onto the electrostatic image recording track of the intermediary transfer belt 24, becoming thereby electrostatic alignment code 32 for toner image alignment. The charge removal brush erases the electrostatic alignment codes 32 recorded on the electrostatic image recording track 25, after the usage of the electrostatic alignment codes 32 in the image forming stations 43*b*, 43*c*, and 43*d*.

There are a pair of corona chargers 46*a* and 46*b* between the belt driving roller 36 and photosensitive drum 12*a*. They are for charging the outward and inward surfaces, respectively, of the intermediary transfer belt 24. They are positioned in such a manner that they vertically sandwich the intermediary transfer belt 24 (electrostatic image recording track). The electrostatic alignment codes 32 on the electrostatic recording track 25 can be reliably erased by the application of a preset AC voltage to the outward and inward corona chargers 46*a* and 46*b*. The voltage to be applied to the outward charger 46*a* is opposite in phase from that to be applied to the inward charger 46*b*.

In a full-color image forming apparatus of the tandem type, it is possible that its multiple photosensitive drums 12 and intermediary transfer belt 24 change in process speed, and/or its intermediary transfer belt 24 snakes. Thus, it is possible that the four image forming stations 43 become different in the amount of difference between the peripheral velocity of a photosensitive drum 12 and the moving speed of the intermediary transfer belt 24, at the transfer station T1. Thus, it is possible that when the multiple (four) monochromatic toner images, different in color, are sequentially transferred in layers onto the intermediary transfer belt 24, they will fail to perfectly align among themselves. Sometimes, therefore, the amount of the positional deviation among themselves amounts to a value in a range of 100-150 μm, resulting in the formation of a full-color image which suffers from color deviation.

It also occurs sometimes that the intermediary transfer belt 24 becomes unstable in speed because of the eccentricity of the belt driving roller 36, nonuniformity in thickness of the intermediary transfer belt 24, and/or the like factors. However, the nonuniformity in speed of the intermediary transfer belt 24, which is attributable to the eccentricity of the belt driving roller 36, and the nonuniformity in thickness of the intermediary transfer belt 24, can be compensated for by measuring in advance the amount of the eccentricity of the belt driving roller 36 and the thickness of the intermediary transfer belt 24.

Further, the drum driving motors 6*a* and 6*b* and belt driving motor 36 sometimes fluctuate in speed. The fluctuation in the speed of the motors can be corrected by an encoder attached to the shaft of each motor.

However, this kind of control is insufficient to raise the level of alignment accuracy at which toner images are transferred in layers onto the intermediary transfer belt 24, to the level of accuracy at which scanning lines are aligned (±20-40 μm). That is, the employment of this kind of control results in the misalignment of the toner images when the toner images are transferred in layers onto the intermediary transfer belt 24. The amount of the toner image misalignment of this type sometimes exceeds the level of the accuracy of scanning lines alignment.

Further, the image forming station 43*a*, 43*b*, 43*c*, and 43*d* are different in the amount by which toner in transferred, being therefore different in the amount of the tension to which the intermediary transfer belt 24 is subjected. Thus, the intermediary transfer belt 24 fluctuates in length. Not only is the amount by which toner is transferred from the photosensitive drum 12 onto the intermediary transfer belt 24 in each image forming station 43 affected by the type of an image to be formed, but also, by the condition under which each image is formed, value of the first transfer voltage, etc. Therefore, it is impossible to predict the amount by which the intermediary transfer belt 24 stretches or shrinks. In other words, as the multiple (four in this embodiment) toner images, different in color, are transferred onto the intermediary transfer belt 24, it is possible that they become misaligned by an unpredictable amount. The fluctuation in the amount of the tension of the intermediary transfer belt 24 makes the length of time it takes for the toner image on the intermediary transfer belt 24, which is from the photosensitive drum 12*a*, to reach the photosensitive drums 12*b*, 12*c*, and 12*d*. Thus, it causes color deviation (misalignment of monochromatic toner images, different in color), the extent of which corresponds to the mount of the fluctuation in the length of time it takes for the toner image from the photosensitive drum 12*a* to reach the photosensitive drums 12*b*, 12*c*, and 12*d*.

In the case of the image forming apparatus 1 in this embodiment, the drum driving motors 6*b*, 6*c*, and 6*d* are controlled in rotation so that the electrostatic alignment codes 31*b*, 31*c*, and 31*d* align with the corresponding electrostatic alignment codes 32 on the electrostatic image recording track 25, in each of the three first transfer areas. With the employment of this control, even if the intermediary transfer belt 24 unpredictably fluctuates in speed, the color deviation attributable to the misalignment of the monochromatic toner images which occurs as the monochromatic toner images are transferred onto the intermediary transfer belt 24 can be prevented. Incidentally, since the image forming station 43*b*, 43*c*, and 43*d* are the same in structure, only the first transfer in the image forming station 43*b* is described. The description of the first transfer in the image forming station 43*c* and 43*d* is the same as that of the first transfer in the image forming station 43*b*, except for the suffixes "c" and "d" of the referential code, with which the suffix "b" of the referential codes in the description of the first transfer in the image forming station 43*b* is replaced.

<Electrostatic Image Recording Track>

Referring to FIG. 2, electrostatic alignment codes 31*a* are formed on the photosensitive drum 12*a*, which is the most upstream photosensitive drum 12 in terms of the moving direction of the intermediary transfer belt 24. These electrostatic alignment codes 31*a* are transferred onto the electrostatic recording track 25 of the intermediary transfer belt 24, and are used to align the toner images formed on the photosensitive drums 12*b*, 12*c*, and 12*d*, one for one, with the toner image from the photosensitive drum 12*a*, when they are transferred onto the intermediary transfer belt 24.

Next, referring to FIG. 3, the intermediary transfer belt 24 is provided with a pair of electrostatic image recording tracks 25, which are on the widthwise end portions of the intermediary transfer belt 24. The position of each electrostatic recording track 25 coincides with the position of the corresponding electrostatic alignment codes 31*a* on the photosensitive drum 12*a*. The electrostatic recording track 25 is formed of PET film which is no less than $10^{14}$ Ω·cm in volume resistivity. It is 50 μm in thickness and 5 mm in width. It is pasted to the intermediary transfer belt 24 along the lengthwise edge of the intermediary transfer belt 24.

The electrostatic image recording track 25 is pasted to the outward surface of the intermediary transfer belt 24 so that it faces the photosensitive drum 12*a*. It is formed of a substance which is high in electrical resistance. Therefore, once electric charge is transferred onto the electrostatic image recording track 25, it remains on the surface of the electrostatic image recording track 25 without changing in position, being therefore capable of functioning as the electrostatic alignment codes 32, that is, the electrostatic alignment codes on the intermediary transfer belt 24.

In comparison, the intermediary transfer belt 24 is formed of a substance, the volume resistivity of which is in a range of $10^9$-$10^{10}$ Ω·cm, in order to ensure that toner images are reliably transferred onto the intermediary transfer belt 24. Thus, if the electrostatic alignment code 31*a* is directly transferred onto the intermediary transfer belt 24, the transferred electrostatic alignment code 31*a*, that is, a body of electric charge, quickly disperses, because the intermediary transfer belt 24 is low in electrical resistance. Thus, the electrostatic alignment code 32, that is, a pattern formed of electric charge, cannot remain intact until it reaches the downstream photosensitive drums 12.

Thus, in order to retain the electrostatic alignment codes 32 on the intermediary transfer belt 24 to align the toner images on the photosensitive drums 12*b*, 12*c*, and 12*d* with the toner image or images on the intermediary transfer belt 24 at the scanning line level of accuracy, it is necessary to paste a pair of electrostatic image recording tracks which are significantly higher in volume resistivity than the intermediary transfer belt 24, to the intermediary transfer belt 24, or a pair of tracks which are higher in volume resistivity, needs to be formed on the intermediary transfer belt 24 by painting or spray painting. The electrostatic recording track 25 may be formed by coating a roll of tape formed of fluorinated resin, such as PTFE, or polyimide, with a substance which is higher in volume resistivity than the intermediary transfer belt 24. There is no requirement regarding the material for the electrostatic image recording track 25. All that is necessary is that the material for the electrostatic image recording track 25 is no less than $10^{14}$ Ω·cm in volume resistivity, and can be adhered to the intermediary transfer belt 24. In other words, the material for the electrostatic image recording track 25 does not need to be limited to fluorinated resin, such as PET and PTFE, and polyimide.

<Electrostatic Alignment Code>

Referring to FIG. 1, the intermediary transfer belt 24 in this embodiment, which is an example of an intermediary transferring member, is provided with the pair of electrostatic image recording tracks 25, which are capable of retaining the electrostatic alignment codes transferred from the photosensitive drum 12*a*, until the electrostatic alignment codes reach the photosensitive drums 12*b*, 12*c*, and 12*d*, which are examples of the second, third, and fourth image bearing members, respectively. Next, referring to FIG. 3, each electrostatic image recording track 25, which is higher in electrical resistance than the area of the intermediary transfer belt 24, across which toner images are transferred, is positioned on the surface of the intermediary transfer belt 24, which comes into contact with the photosensitive drum 12*a*. Further, its position coincides with one of the two lengthwise end portions of the peripheral surface of the photosensitive drum 12*a*, which is outside the area of the peripheral surface of the photosensitive drum 12*a*, on which an electrostatic latent image is developed.

Referring again to FIG. 3, the exposing apparatus (16*a* in FIG. 1) writes the two sets of electrostatic alignment codes 31*a* on the lengthwise end portions of the peripheral surface of the photosensitive drum 12*a*, one for one, which are outside the toner image formation range in terms of the lengthwise direction of the photosensitive drum 12*a*, by the beam of laser light which it projects before and after it writes an electrostatic latent image of the image to be formed. In order to prevent the electrostatic alignment codes 31*a* written on the photosensitive drum 12*a* from being developed with toner, the developing device 18*a* is limited in the development range, in terms of the lengthwise direction of the photosensitive drum 12*a* so that the areas of the photosensitive drum 12*a* having the electrostatic marks 31*a* do not fall in the development range of the developing device 18*a*.

The electrostatic alignment codes 31*a* begin to be written immediately after the photosensitive drum 12*a* begins to be rotated, and also, before the electrostatic latent image of the image to be formed begins to be written on the photosensitive drum 12. They are continuously written until the formation of the image to be formed ends.

The dimension of each electrostatic alignment code 31*a* in terms of the lengthwise direction of the photosensitive drum 12*a* is 5 mm, for example. As for the pitch at which the electrostatic alignment codes 31*a* are formed, in a case where the resolution of the image forming apparatus 1 in terms of the secondary scan direction is 1,200 dpi, the value obtained multiplying 42.3 μm by n is used as the pitch for the electrostatic alignment code 31*a*, since 25.4÷1200=0.0423 (mm). The value for n is determined according to the level of accuracy at which a potential sensor can detects the electrostatic alignment code 31*a*.

<Roller for Transferring Electrostatic Alignment Code>

Referring to FIG. 3, it is in the first transfer area, that is, the area of contact between the photosensitive drum 12*a* and intermediary transfer belt 24, that the two electrostatic alignment codes 31*a* formed on the photosensitive drum 12*a* are transferred onto the pair of electrostatic image recording tracks 25 of the intermediary transfer belt 24, one for one. A pair of transfer rollers 47 for transferring the electrostatic alignment codes 31*a* are on the outward side of the first transfer roller 4*a* in terms of the lengthwise direction of the first transfer roller 4*a*. In terms of the lengthwise direction of the first transfer roller 4*a*, the position of each electrostatic alignment code transfer roller 47 coincides with the position of the corresponding electrostatic image recording track 25. That is, in terms of the widthwise direction of the intermediary transfer belt 24, the portions of the intermediary transfer belt 24, which have the electrostatic image recording tracks 25, one for one, coincide with the electrostatic alignment code transfer rollers 47, one for one.

Each electrostatic alignment code transfer roller 47, which is an example of transferring means, transfers the electrostatic alignment code 31*a* on the photosensitive drum 12*a*, onto the electrostatic image recording track 25 of the intermediary transfer belt 24, by providing the intermediary transfer belt 24 with potential, from the opposite side of the intermediary transfer belt 24 from the photosensitive drum 12*a*. Each electrostatic alignment code transfer roller 47 is supported so that its axial line coincides with the axial line of the first transfer roller 4*a*, which transfers a toner image onto the intermediary transfer belt 24. The voltage applied to the electrostatic alignment code transfer roller 47 is different from that applied to the first transfer roller 4*a*.

The first transfer roller 4*a* is an electrically conductive sponge roller. As a DC voltage set to maximize the first transfer roller in toner transfer efficiency is applied to the first transfer roller 4*a*, the first transfer roller 4*a* transfers the toner image on the photosensitive drum 12, onto the surface of the intermediary transfer belt 24 by attracting the toner image onto the intermediary transfer belt 24.

In comparison, the electrostatic alignment code transfer roller 47, which also is an electrically conductive sponge roller as is the first transfer roller 4*a*, is structured so that voltage which is different from the one which is applied to the first transfer roller 4*a*, can be applied to the electrostatic alignment code transfer roller 47. That is, to the electrostatic alignment code transfer roller 47, a DC voltage, the magnitude of which is set to maximize the electrostatic alignment code transfer roller 47 in reproducibility of the electrostatic alignment code, which is made up of electrical charge, is applied to transfer the electric charge, of which the electrostatic alignment code 31*a* is made up, onto the electrostatic image recording track 25. As the DC voltage is applied to the electrostatic alignment code transfer roller 47, a part of the electric charge, of which the electrostatic alignment code 31*a* is made up, is transferred onto the electrostatic image recording track 25, whereby the electrostatic alignment code 32, which is the same in pitch as the electrostatic alignment code 31*a*, is formed on the electrostatic image recording track 25, as shown in FIG. 2.

The portions of the intermediary transfer belt 24, which have the electrostatic image recording track 25, are thicker than the rest of the intermediary transfer belt 24. However, the electrostatic alignment code transfer roller 47 which is a sponge roller, is slightly different (less) in diameter from the first transfer roller 4*a* which also is a sponge roller. Thus, the electrostatic alignment code transfer roller 47 can compensate for the difference in thickness between the portions of the intermediary transfer belt 24, which have the electrostatic image recording track 25 and the rest of the intermediary transfer belt 24. Therefore, the difference in thickness between the portions of the intermediary transfer belt 24, which have the electrostatic image recording track 25 and the rest of the intermediary transfer belt 24 does not affect the circular movement of the intermediary transfer belt 24.

In this embodiment, the volume resistivity of the intermediary transfer belt 24 is $10^{10}$ Ω·cm, and the volume resistivity of the electrostatic image recording track 25 is $10^{14}$ Ω·cm. In one of the experiments, +500 V which is different from (higher than) the voltage (100 V) to be applied to the first transfer roller 4*a*, was applied to the electrostatic alignment code transfer roller 47. In this case, the difference between the potential level (−100 V) of the electrostatic alignment code 31*a* (exposed area) and the magnitude (+500 V) of the voltage applied to the electrostatic alignment code transfer roller 47 was 600 V, whereas the difference between the potential level (−600 V) of the interval of the electrostatic alignment code 31*a* and the magnitude (500 V) of the voltage applied to the electrostatic alignment code transfer roller 47 was 1,100 V.

Figure 29:
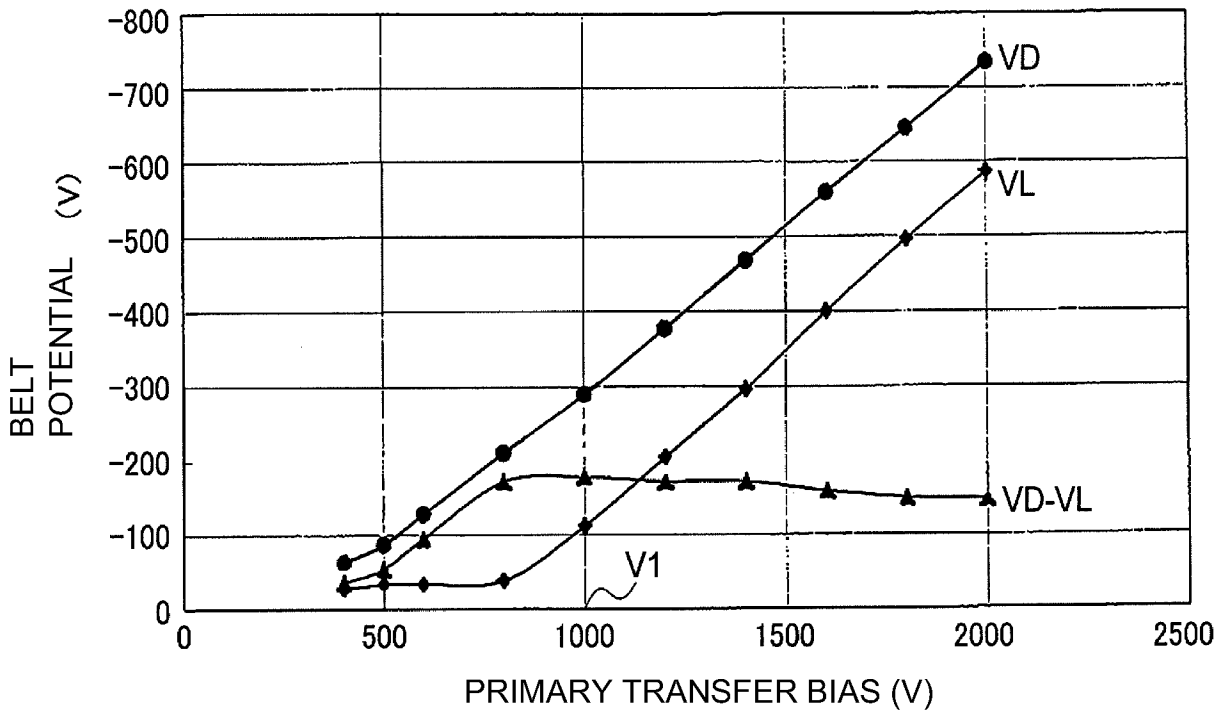
FIG. 29 is an illustration of a relation between a transfer bias voltage and a potential transferred to the electrostatic image recording track.

Next, referring to FIG. 29, as the first transfer bias to be applied to the electrostatic alignment code transfer roller 47 is changed, a point of the electrostatic image recording track 25, which is in contact with a point of the peripheral surface of the photosensitive drum 12*a*, the voltage of which is VL (light point voltage: voltage of exposed point) becomes different in potential from a point of the electrostatic image recording track 25, which is in contact with a point of the peripheral surface of the photosensitive drum 12*a*, the voltage of which is VD (dark point voltage: voltage of unexposed point). The electrical discharge between the photosensitive drum 12*a* and electrostatic image recording track 25 is affected by the difference (VD−VL) in potential between an exposed point of the electrostatic image and an unexposed point of the electrostatic image. This is how the pattern of the potential of the peripheral surface of the photosensitive drum 12*a* is transferred onto the electrostatic image recording track 25.

In the case of this experiment, when 500 V was applied to the electrostatic alignment code transfer roller 47, the surface potential of the electrostatic image recording track 25 after the transfer was such that a point of electrostatic image recording track 25, which corresponds in position to an exposed point of the peripheral surface of the photosensitive drum 12*a* was roughly −30 V, whereas a point of the electrostatic image recording track 25, which corresponds in position to an unexposed point of the peripheral surface of the photosensitive drum 12*a* was roughly −90 V. The electrostatic alignment codes 32 which were formed on the intermediary transfer belt 24 by transferring the electrostatic alignment codes 31*a*, which were made up of the points of the peripheral surface of the photosensitive drum 12*a*, which are −600 V in potential and the point of the peripheral surface of the photosensitive drum 12*a*, which are −100 V, onto the intermediary transfer belt 24, were made up of the superficial points of the intermediary transfer belt 24, which were roughly −30 V in potential and the superficial points of the intermediary transfer belt 24, which were roughly −90 V in potential.

Whether the toner (toner image) on the photosensitive drum 12*a* is transferred onto the intermediary transfer belt 24, or the electrostatic alignment code 31*a* on the photosensitive drum 12*a* is transferred onto the electrostatic image recording track 25 of the intermediary transfer belt 24, the optimal condition for the transfer is affected by the material, measurements, and shape of each component related to the transfer, and the changes in the ambience of the image forming apparatus 1. Further, instead of the electrostatic alignment code transfer roller 47, a corona-based charging device which employs a piece of wire, a charging device which uses a charge removal wick employed by a charge removing device or the like, or a blade-based charging device may be employed as the means for transferring the electrostatic alignment code 31*a*.

<Potential Sensor of Antenna Type>

Figure 5:
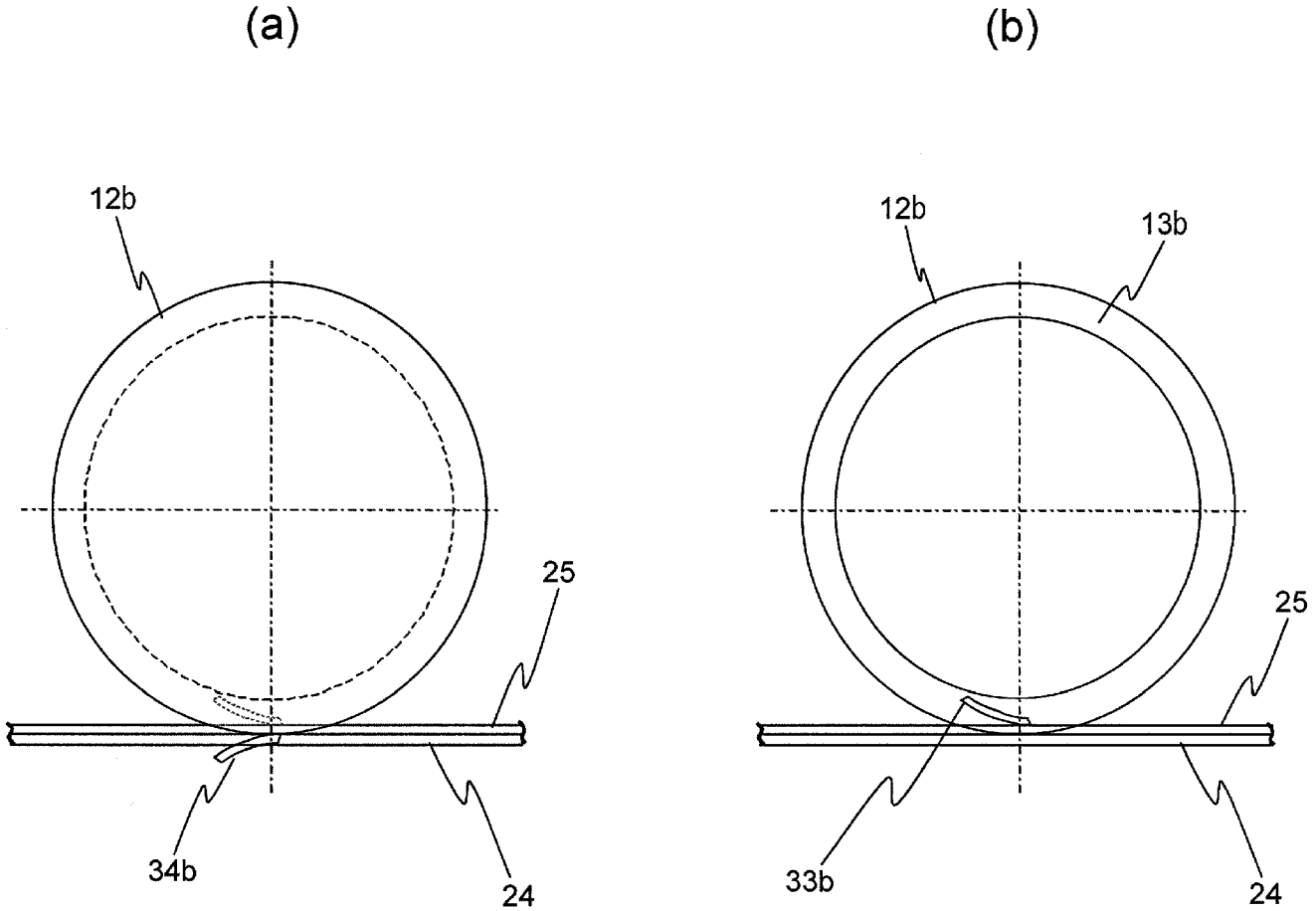
FIG. 5 is an illustration of position of the potential sensor.
Figure 6:
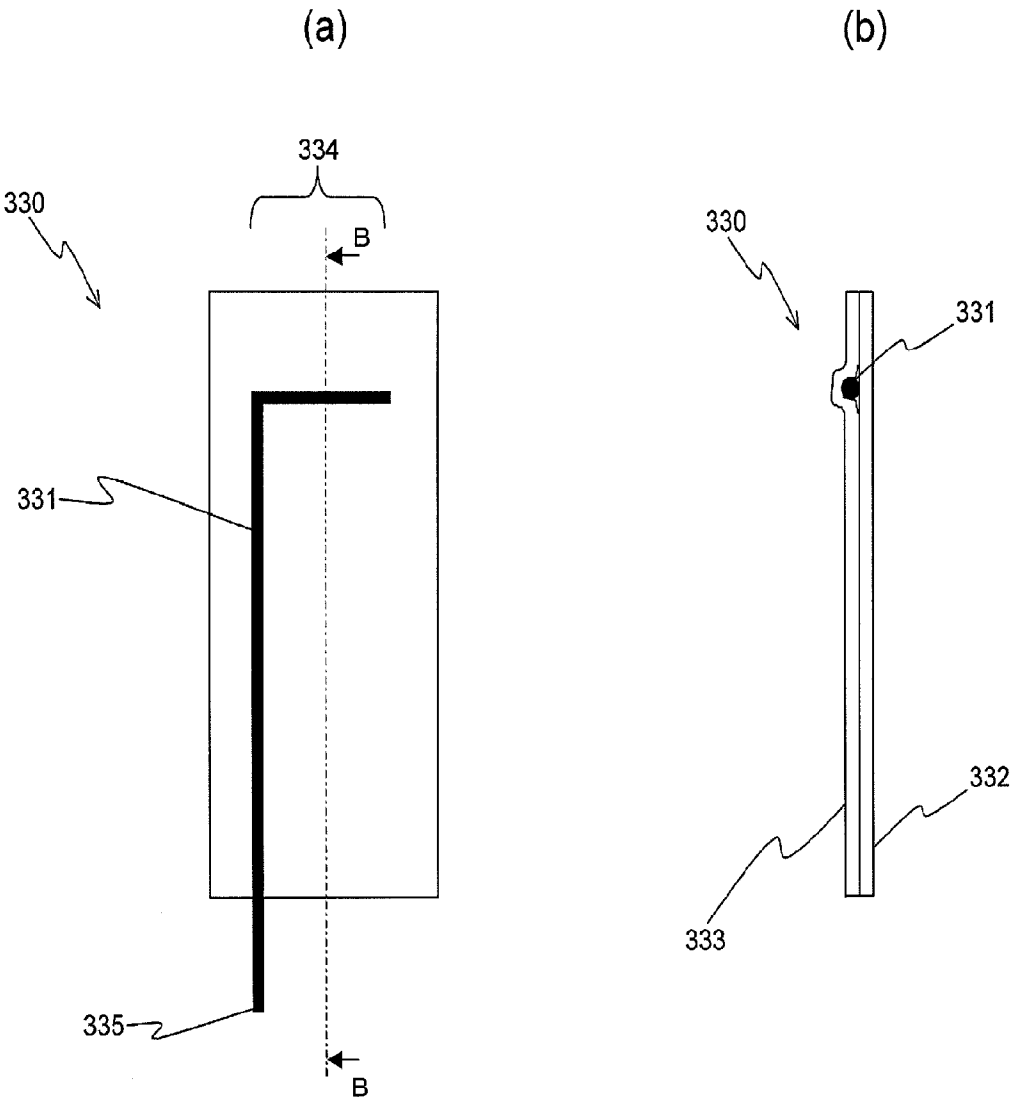
FIG. 6 is an illustration of a structure of the potential sensor.
Figure 7:
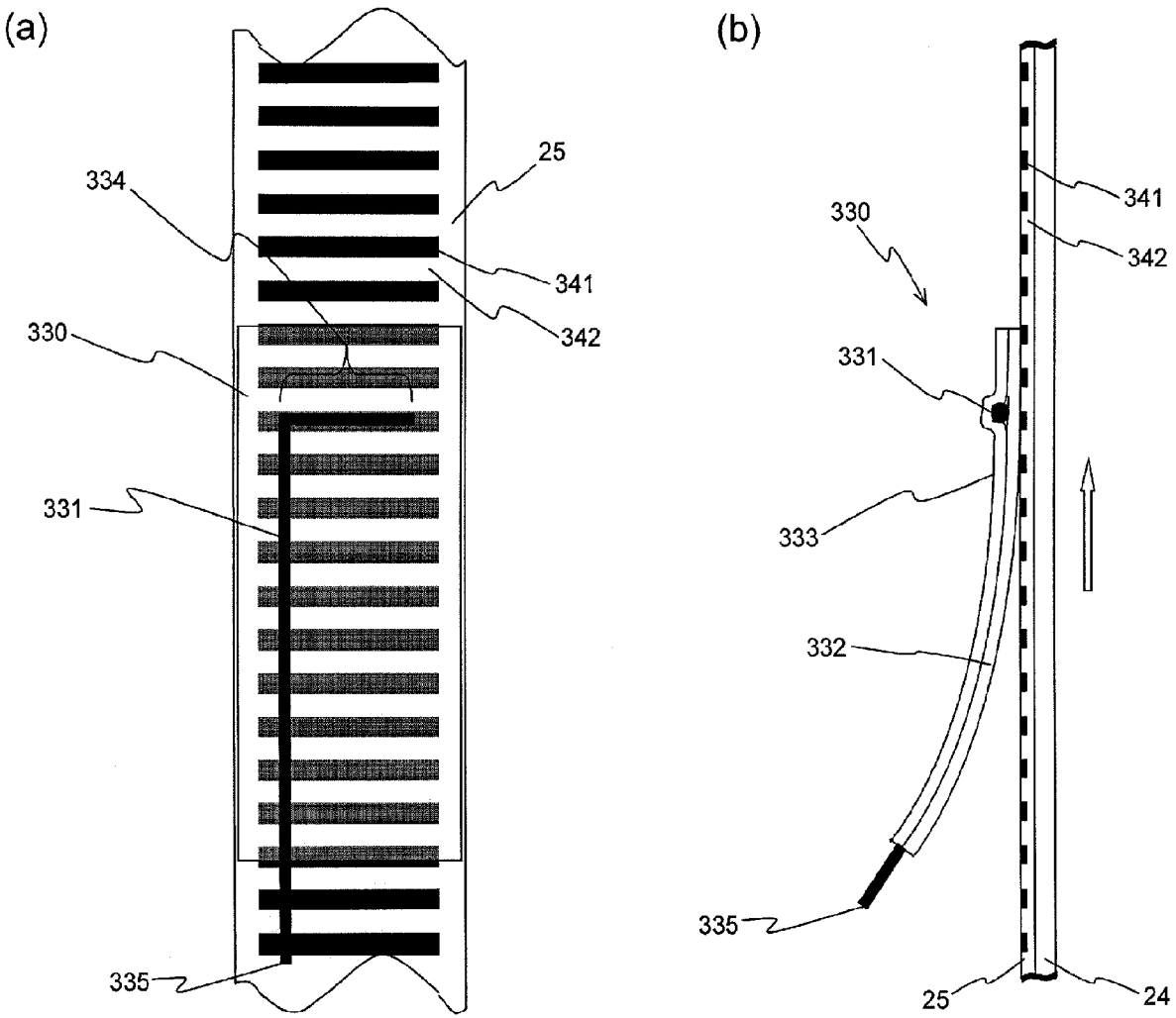
FIG. 7 is an illustration of the detection of the electrostatic image code by the potential sensor.
Figure 8:
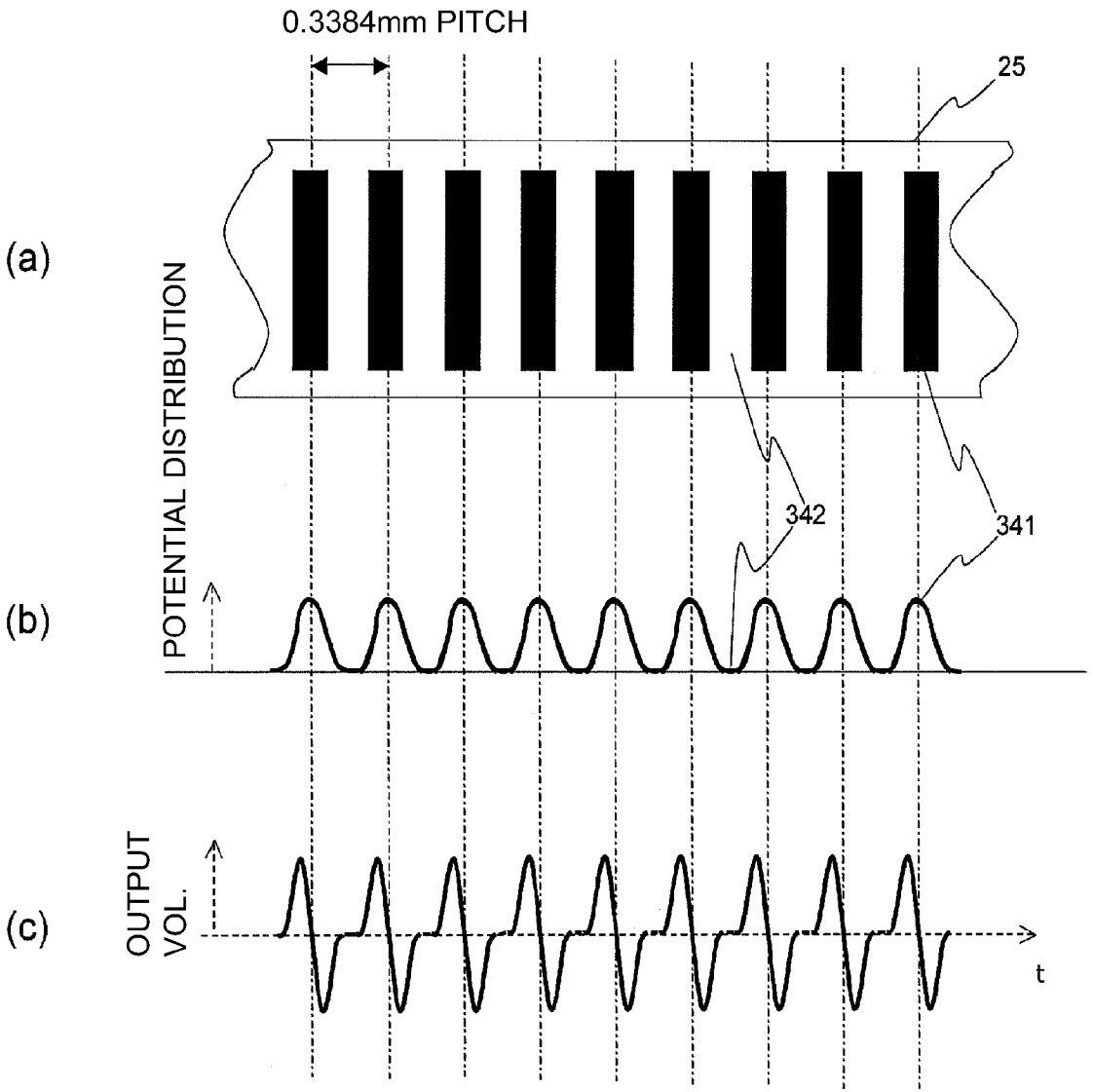
FIG. 8 is an illustration of a detection signal of the electrostatic image code.
Figure 10:
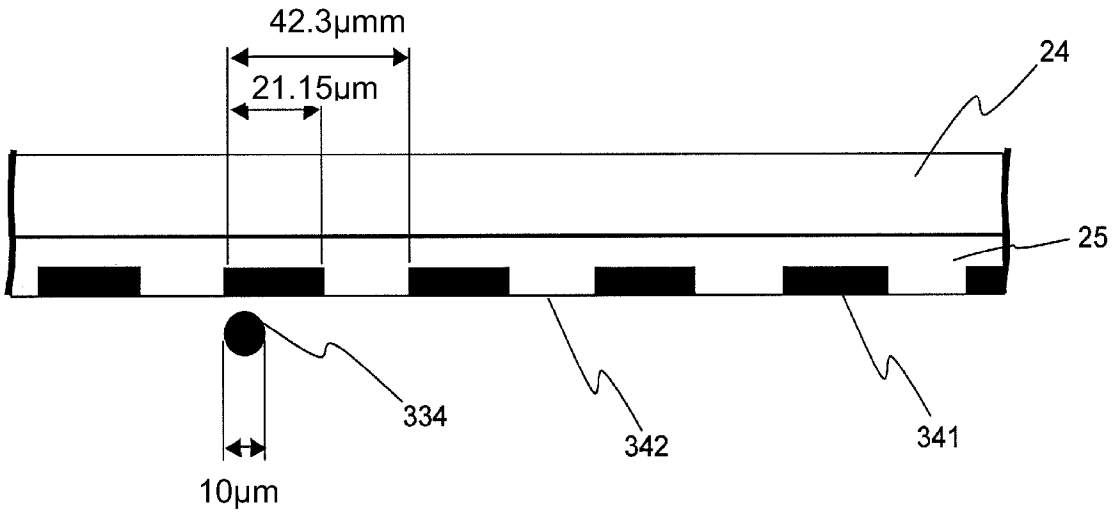
FIG. 10 is an illustration of the detection of an electrostatic image code having a minimum pitch.

FIG. 5 is a drawing for describing the positioning of the potential sensor. FIG. 6 is a drawing for describing the structure of the potential sensor. FIG. 7 is a drawing for describing the detection of the electrostatic alignment code by the potential sensor. FIG. 8 is a drawing for describing the signals outputted by the potential sensor when the electrostatic alignment code is detected by the potential sensor. FIG. 10 is a drawing for describing the signals outputted by the potential sensor as the electrostatic alignment code which is smallest in pitch is detected.

Referring to FIGS. 4 and 5(*a*), in the image forming station 43*b*, the electrostatic alignment code 31*b* formed on the photosensitive drum 12*b* is detected by a sensor 34*b* dedicated to the reading of the electrostatic alignment code 31*b*. Next, referring to FIG. 5(*b*), the electrostatic alignment code 32 formed on the intermediary transfer belt 24 by transferring the electrostatic alignment code 31*a* from the photosensitive drum 12*a* onto the intermediary transfer belt 24 is detected by a sensor 33*b* dedicated to the reading the electrostatic alignment code 32.

Similarly, in the image forming station 43*c* shown in FIG. 1, the electrostatic alignment code 31*c* on the photosensitive drum 12*c* is detected by a sensor 34*c* dedicated to the reading of the electrostatic alignment code 31*c*, and the electrostatic alignment code on the intermediary transfer belt 24 is detected by the sensor 33*c* dedicated to the reading of the electrostatic alignment code 32. In the image forming station 43*d*, the electrostatic alignment code 31*d* on the photosensitive drum 12*d* is detected by a sensor 34*d* dedicated to the reading of the electrostatic alignment code 31*d*, and the electrostatic alignment code 32 on the intermediary transfer belt 24 is detected by a sensor 33*d* dedicated to the reading of the electrostatic alignment code 32.

Each of the sensors 34*b*, 34*c*, and 34*d* dedicated to the reading of the electrostatic alignment codes on the photosensitive drum, and the sensors 33*b*, 33*c*, and 33*d* dedicated to the reading of the electrostatic alignment codes 32 on the intermediary transfer belt 24, is a potential sensor of the antenna type (330 in FIG. 6). As the electrostatic alignment code moves relative to the potential sensor, the sensor detects the changes in the potential. The basic structure, operational principle, and manufacturing method of the sensors 34 and 33 are disclosed in detail in Japanese Laid-open Patent Application 2010-60761 applied by the inventors of the present invention. Here, therefore, only the unique portions of the sensors in this embodiment are described.

Next, how the potential level distribution of the electrostatic image recording track 25 is obtained with the use of a potential sensor is described. The method for reading the electrostatic alignment codes written on the photosensitive drums 12*b*, 12*c*, and 12*d* with the potential sensor is the same as the method for reading the electrostatic alignment codes on the intermediary transfer belt 24.

Referring to FIG. 6(*a*), the potential sensor 330 comprises: a base film 332; an electrically conductive wire 331; and a protective film 333. The electrically conductive wire 331 is made of a piece of metallic wire, and is 20 μm in diameter. It is bent in the shape of a letter L. The base film 332 is made of polyimide, and is 4 mm in width, 15 mm in height length, and 25 μm in thickness. The protective film 333 also is made of polyimide, and is the same in width, length, and thickness as the base film 332. The L-shaped conductive wire 331 is placed on the base film 332 after the base film 332 is coated with adhesive. The lengthwise end of the wire 334, which is at the opposite end of the sensor 330 from the potential sensing end, is the signal outputting portion 335.

Next, referring to FIG. 6(*b*), after the conductive wire 331 is placed on the adhesive-coated base film 332, the protective film 333 is adhered to the base film 332. Thus, basically, the adhesive is present only between the base film 332 and protective film 333. That is, the adhesive is not present between the conductive wire 331 and base film 332, and between the conductive wire 331 and protective film 333. Therefore, the distance between the conductive wire 331 and base film is 25 μm, and so is the distance between the conductive wire 331 and the protective film 333.

Next, referring to FIG. 7(*a*), the black bars 334 represent the high potential areas (relative to while bars, or intervals, among black bars) of the electrostatic alignment code transferred onto the electrostatic image recording track 25, whereas the white bars 342 (intervals among black bars) represent the low potential areas (relative to black bars) of the electrostatic alignment code transferred onto the electrostatic image recording track 25. The aforementioned potential sensor 330 is solidly attached to an unshown support in such a manner that the potential sensing edge 334 of the sensor 330 becomes parallel to the high voltage (and low voltage) black (and white) bars of the electrostatic image recording track 25. That is, the sensor 330 is used as the sensor 33 for reading the electrostatic alignment codes on the intermediary transfer belt 24.

Next, referring to FIG. 7(*b*), the sensor 330 is positioned so that the opposite surface of the base film 332 from the surface on which the conductive wire 331 is, is placed in contact with the electrostatic image recording track 25. As the sensor 330 is positioned as described above, the potential sensor 330 is bent, providing thereby a proper (necessary) amount of contact pressure between the sensor 330 and electrostatic image recording track 25 utilizing the resiliency of the sensor 330. Therefore, the distance between the portion of the conductive wire, which is parallel to the potential sensing edge of the sensor 330, and the electrostatic image recording track 25 remains stable.

Incidentally, a spring may be employed to keep the potential sensor 330 pressed upon the electrostatic image recording track 25 so that the aforementioned distance remains stable.

Next, referring to FIG. 8(*a*), the electrostatic alignment codes 32 on the electrostatic image recording track 25, which were formed by transferring the electrostatic alignment code 31*a* from the photosensitive drum 12*a* onto the electrostatic image recording track 25, is made up of high and low voltage bars 341 and 342, which are alternately positioned. Each high voltage bar 341 corresponds to an exposed portion of the peripheral surface of the photosensitive drum 12*a*, whereas each low voltage bar 342 corresponds to an unexposed portion of the peripheral surface of the photosensitive drum 12*a*.

In this embodiment, the high and low voltage bars 341 and 342 were roughly −30 V and −90 V, respectively, in potential level.

Also in this embodiment, in order to detect the position of the bars at an accuracy level equivalent to the accuracy of the scanning line alignment at a resolution of 1,200 dpi, each bar which corresponds to the exposed portion of the peripheral surface of the photosensitive drum 12*a* is equivalent in width to 8 scanning lines, and each bar which corresponds to the unexposed portion of the peripheral surface of the photosensitive drum 12*a* is equivalent in width also to eight scanning lines. Thus, the pitch of the black bars (white bars) is 16 times the pixel pitch at a resolution of 1,200 dpi. That is, the pitch is 0.3384 (=0.2115 mm×16). Thus, the images are layered in alignment at a level of accuracy which corresponds to 16 scanning line.

Next, referring to FIG. 8(*b*), the distribution of the potential of the electrostatic alignment codes 32 on the electrostatic image recording track 25 is equivalent to the distribution of the amount of the exposure of the peripheral surface of a photosensitive drum 12 by the beam of laser light. Since the peripheral portions of the electrostatic alignment code attenuates in potential. Therefore, the outputs of the sensor 330 are not in a perfect rectangular pattern. That is, as the potential sensor 330 is moved along the electrostatic alignment code, which has the above described potential distribution pattern, the output of the potential sensor 330 displays a waveform shown in FIG. 8 (*c*).

Referring again to FIG. 7(*a*), as the electrostatic image recording track 25 moves under the potential sensor 330, the adjacencies of the potential detecting portion 334 of the potential sensor 330 changes in potential. Thus, electrical current is induced in the detecting portion 334 of the potential sensor 330, which in turn causes the output voltage of the output portion 335 of the potential sensor 330 to change. Next, referring to FIG. 8(*c*), the waveform of the output voltage of the output portion 335 is equivalent to the waveform obtained by differentiating the potential distribution shown in FIG. 8(*b*).

A peak (0 in inclination) of the waveform of the potential distribution in FIG. 8(*b*) corresponds to the center of each electrostatic bar of the electrostatic alignment code, and a point in time at which the output voltage shown in FIG. 8(*c*) becomes zero corresponds to when the center of the electrostatic bar was detected.

Referring to FIG. 8(*a*), the electrostatic alignment code 32 which is made up of black and white bars (electrostatic bars), the width of which corresponds to 8 scanning line are coarse in pitch relative to the thickness of the electrically conductive wire. Therefore, there is a short length of time between when the potential detecting portion 334 changes in potential and when the potential detecting portion 334 changes next time in potential. Thus, the waveform of the output signal of the potential sensor 330 displays the pattern shown in FIG. 8(*c*), which is different from the sine wave.

Figure 9:
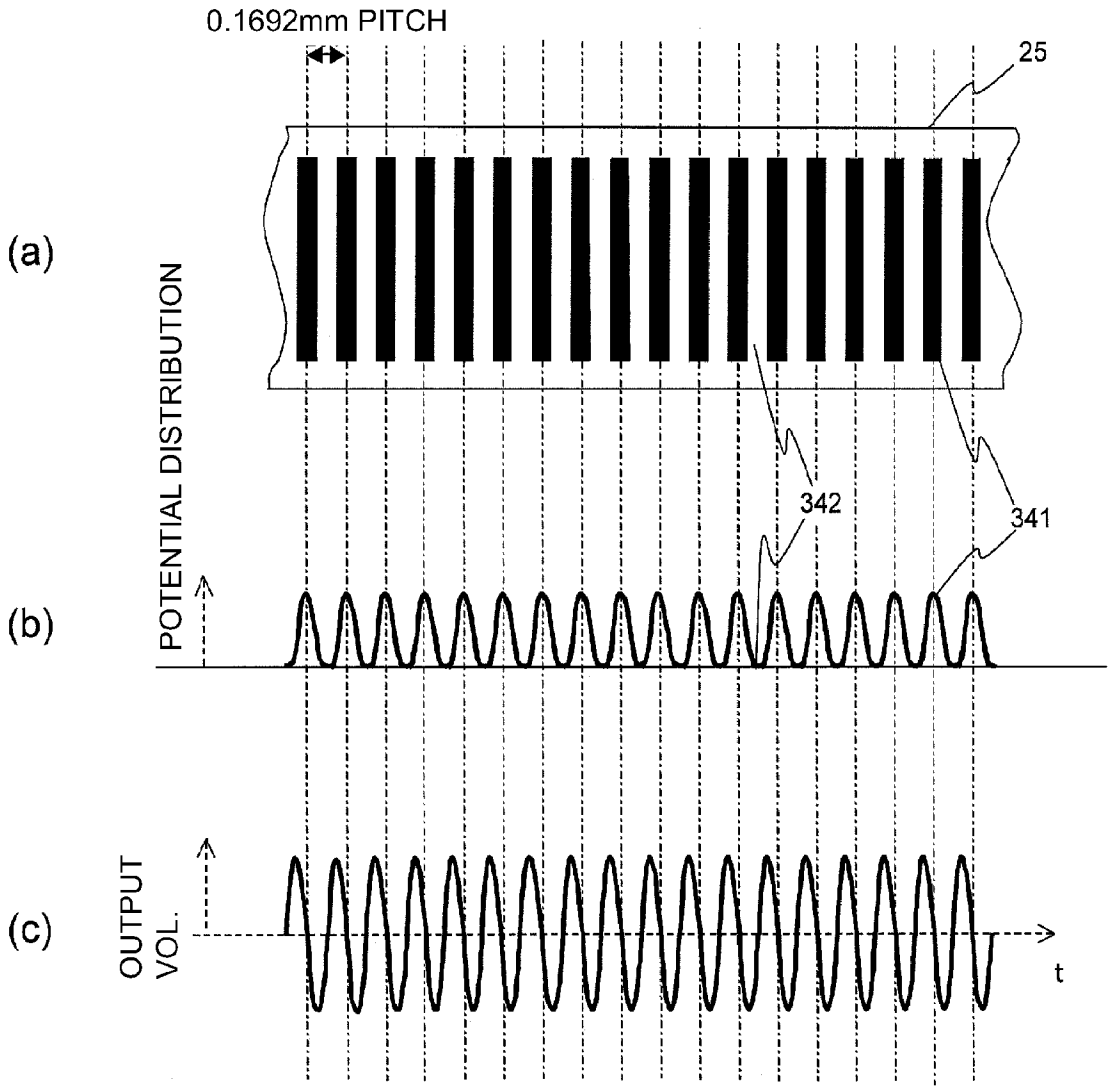
FIG. 9 is an illustration of a detection signal of electrostatic image code having different pitches.

Next, referring to FIG. 9(*a*), an electrostatic alignment mark (bar), the width of which corresponds to four scanning lines is 0.1692 μm in pitch, is right in pitch relative to the thickness of the conductive wire 331. Therefore, when this electrostatic alignment code is used, the output of the potential sensor is nearly in the form of a sine wave.

Next, referring to FIG. 10, if the resolution of the image forming apparatus 1 is 1,200 dpi, it is possible to create an electrostatic alignment code, the pitch of which is 42.3 μm which is equivalent to two scanning lines. Since the width of each bar is 21.15 μm, the thickness of the conductive wire 331 of the detecting portion 334 has to be no more than half the width (21.15 μm) of each bar, for example, 10 μm. Theoretically, with this setup, the potential sensor 330 is capable of detecting an electrostatic alignment code, the pitch of which is the smallest one attainable when the resolution of the image forming apparatus 1 is at 1,200 dpi, and the output of the potential sensor 330 is in the form of a sine wave. Therefore, the electrostatic alignment codes 31*b*, 31*c*, and 31*d* can be aligned with the electrostatic alignment codes 32 at a scanning line level of accuracy, assuming that a point in time at which the output of the potential sensor 330 becomes zero is the point in time at which each electrostatic alignment mark (each bar or space) is detected by the potential sensor 330. Therefore, the electrostatic alignment codes made up of a distribution of potential can be measured at a satisfactorily high level of accuracy, with the use of the potential sensor 330 which detects the fluctuation in the potential, which occurs as the electrostatic alignment codes are moved under the potential sensor 330.

<Division (Halving) of Electrostatic Alignment Mark>

Figure 11:
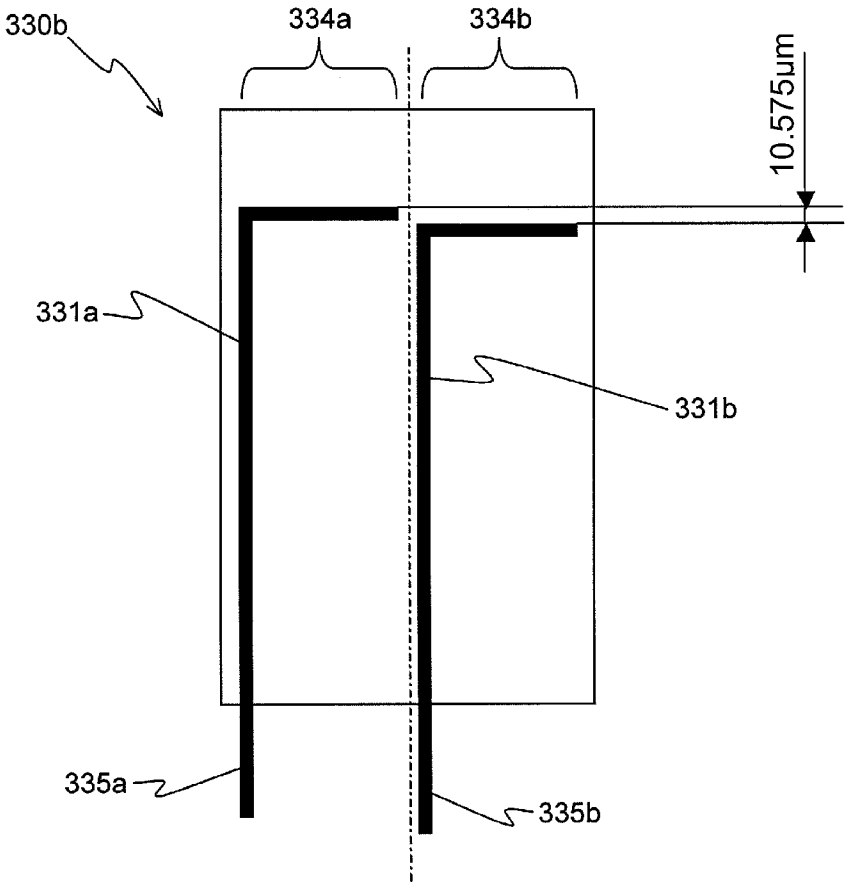
FIG. 11 is an illustration of an electrostatic sensor for dividing the codes.
Figure 12:
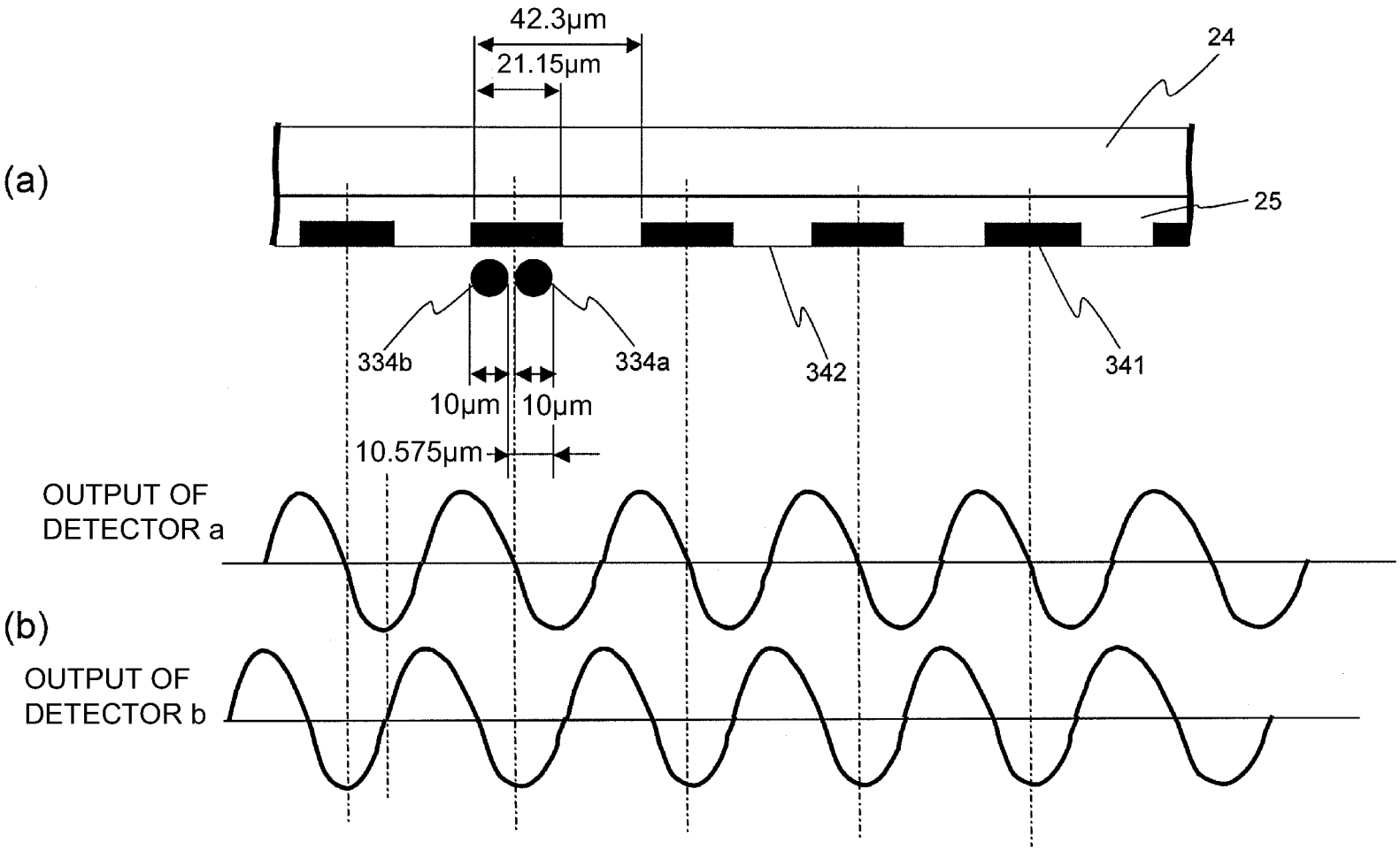
FIG. 12 is an illustration of the division of the codes.

FIG. 11 is a drawing for describing a potential sensor for dividing (halving) the electrostatic alignment mark. FIG. 12 is a drawing for describing the division (halving) of the electrostatic alignment mark. The electrostatic alignment code shown in FIG. 10, which is made up of alternately positioned high and low potential bars at a pitch of 42.3 μm can be used to obtain such a signal output which is smaller in pitch than the electrostatic alignment code itself. Further, the electrostatic alignment code shown in FIG. 9, which is made up of alternately positioned high and low potential bars at a pitch of 0.1692 mm can used to obtain an output which is 42.3 μm in pitch, with the use of the same dividing (halving) method as the one usable with the electrostatic alignment code shown in FIG. 10.

Referring to FIG. 11, a potential sensor 330 has two conductive wires 331*a* and 331*b*, which are offset from each other by 10.575 μm in the direction parallel to the direction in which the intermediary transfer belt 24 is moved. This potential sensor 330 can read the electrostatic alignment code at a higher level of resolution than the potential sensor 330 shown in FIG. 6. More concretely, referring to FIG. 12(*a*), positioning the detecting portions 334*a* and 334*b* so that they offset from each other by one fourth the graduation pitch (42.3 μm) of the electrostatic alignment code, that is, by 90° in terms of the waveform phase makes it possible for the potential sensor 330 to output two signals, which are offset from each other by 90°. Thus, an output signal which is 21.15μ in pitch and has four peaks per pitch can be obtained by combining the two outputs.

As for the method for graduating the electrostatic alignment code, there is no need for using a new method. For example, the minimum pitch can be divided by 16 and 64 with the use of the method disclosed in Japanese Laid-open Patent Application 2003-161645. With the use of this method, it is possible to obtain such an output that is 0.66 μm (=42.3 μm÷64) in pitch. Thus, it is possible to obtain alignment signals sufficient for aligning multiple monochromatic images of which a multicolor image is made, at a micrometer level of accuracy, that is, at a scanning line level of accuracy.

<Toner Image Alignment Control>

Figure 13:
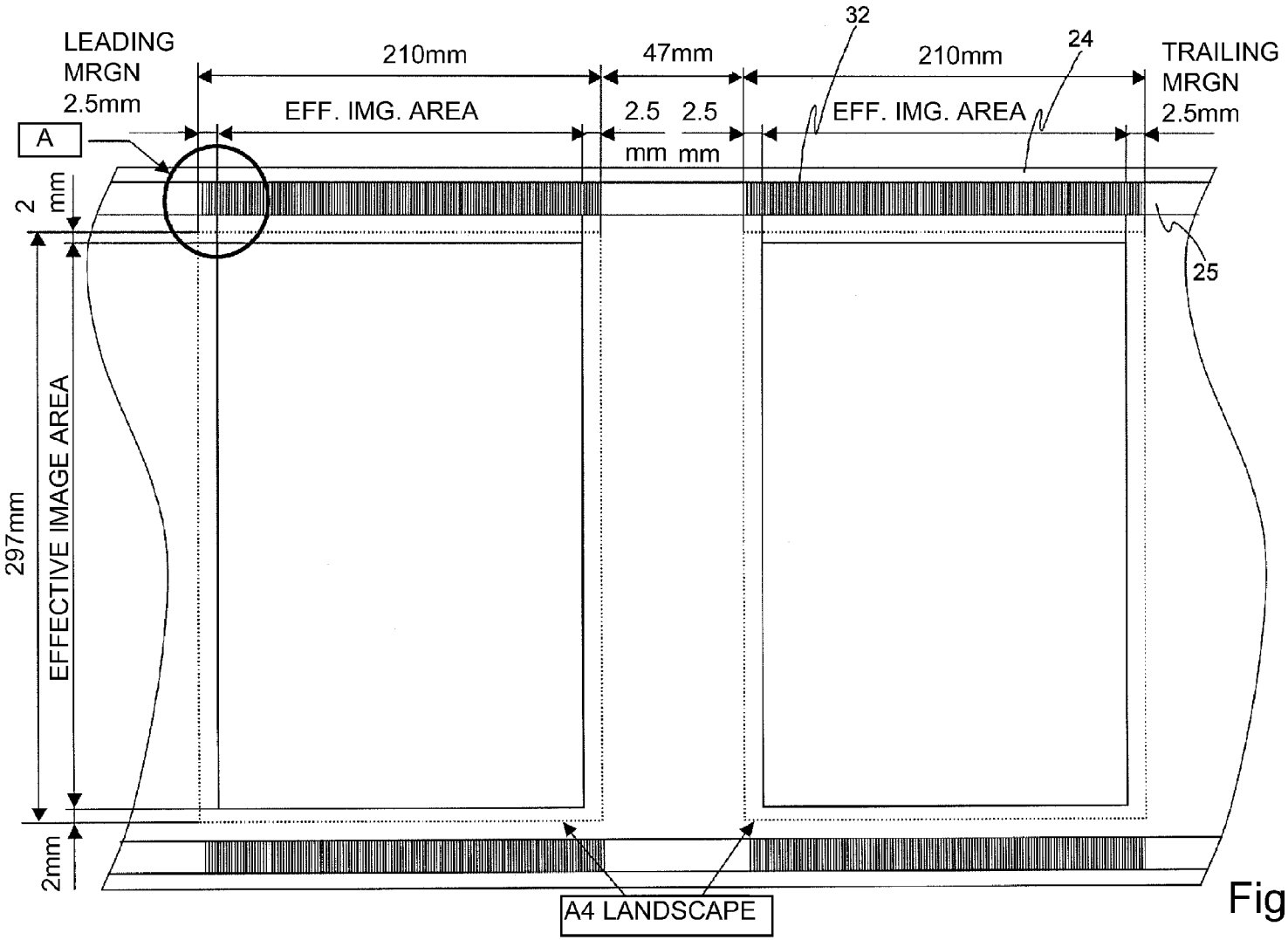
FIG. 13 is an illustration of a positional relation between the toner image on an intermediary transfer belt and electrostatic image code.
Figure 14:
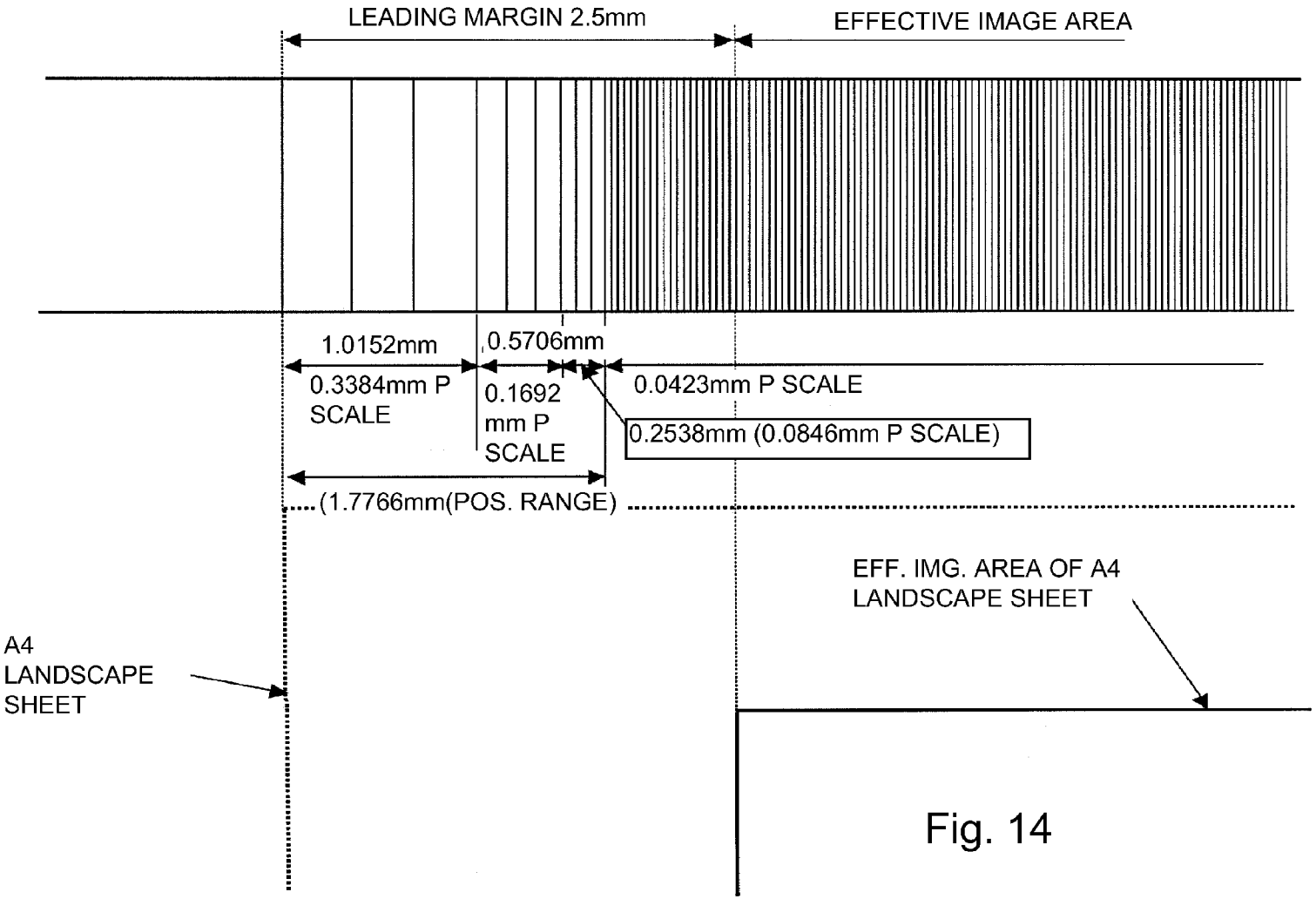
FIG. 14 is an illustration of a first portion of the electrostatic image code.
Figure 15:
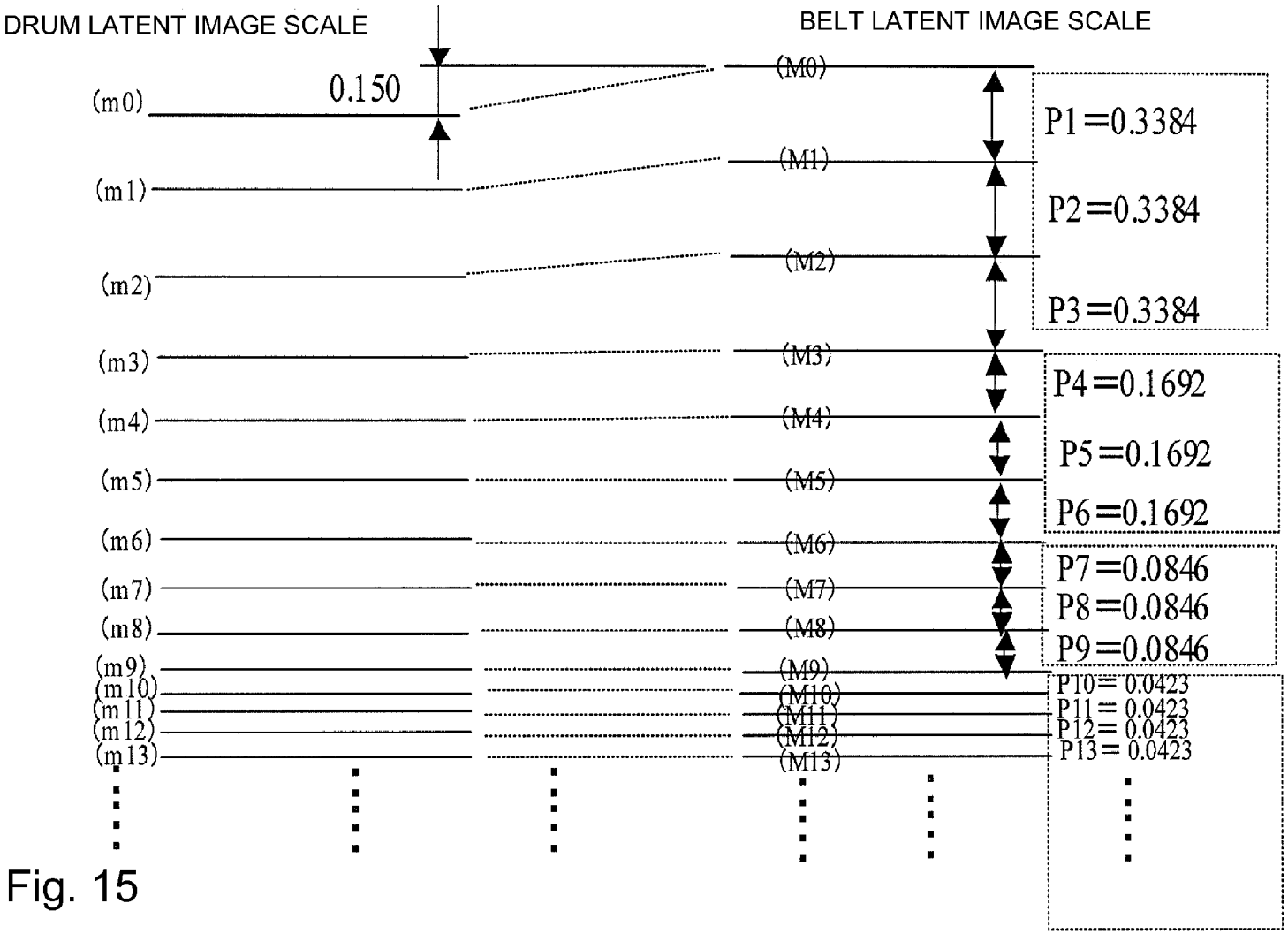
FIG. 15 is an illustration of code alignment with the drum code.
Figure 16:
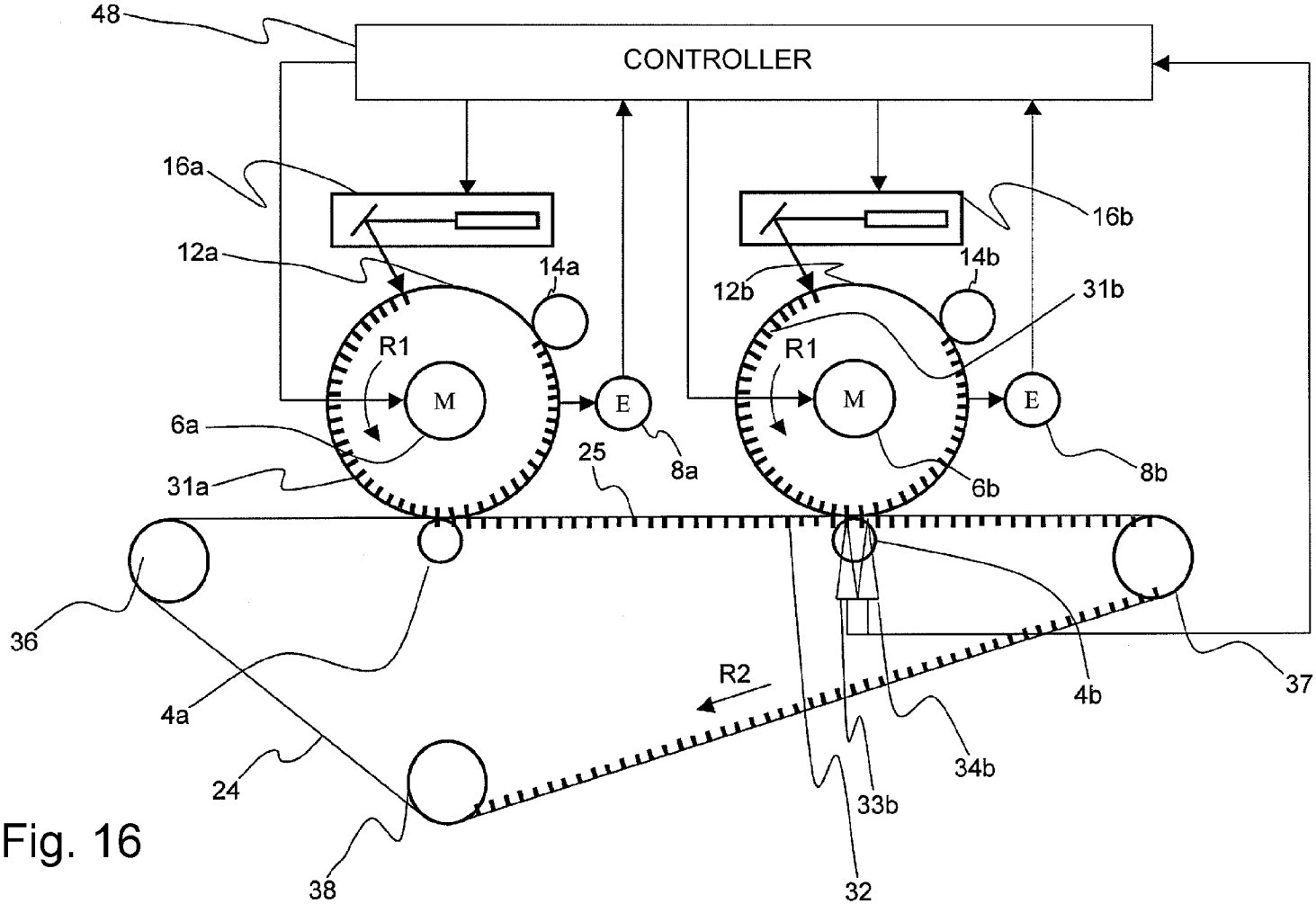
FIG. 16 is an illustration of alignment control for the toner images using the electrostatic image code.
Figure 17:
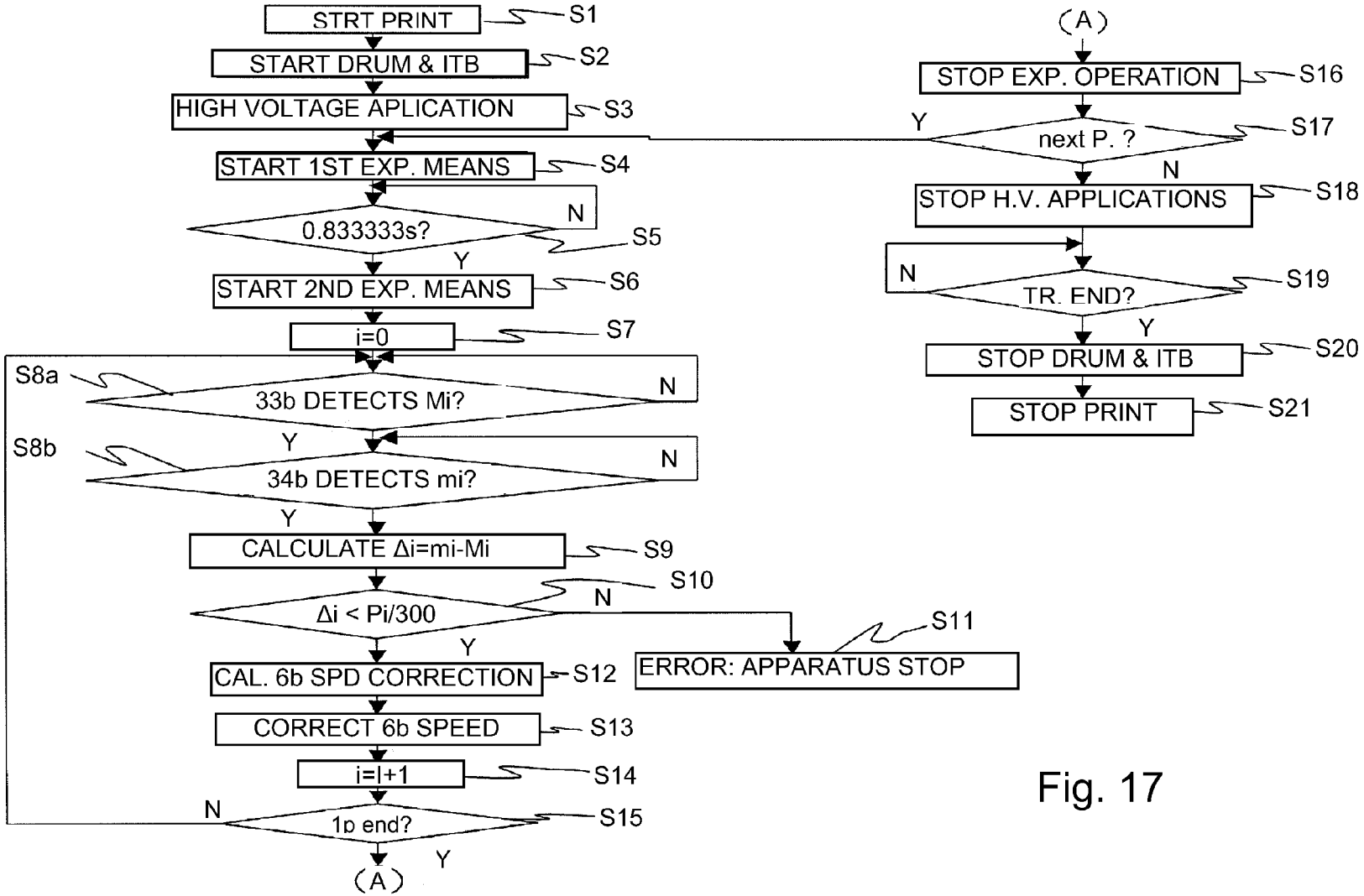
FIG. 17 is a flow chart of the toner image alignment control using an electrostatic image code.

FIG. 13 is a drawing for describing the positional relationship between a toner image on the intermediary transfer belt 24 and an electrostatic image recording track 25 on the intermediary transfer belt 24. FIG. 14 is a drawing of the leading end portion of the electrostatic alignment code. FIG. 15 is a drawing for describing the method for aligning the electrostatic alignment code on the drum and the electrostatic alignment code on the intermediary transfer belt 24. FIG. 16 is a drawing for describing the operation for aligning toner images with the use of the electrostatic alignment codes. FIG. 17 is a flowchart of the control sequence for aligning toner images with the use of the electrostatic alignment codes.

Next, the control sequence carried out in the magenta image formation station 43*b* to align the toner image on the photosensitive drum 12*b* with the toner image on the intermediary transfer belt 24 is described. The control sequence carried out in the cyan and black image formation stations 43*c* and 43*d* to align toner images are the same as that in the magenta image formation station 43*b*. Incidentally, it is a common practice to provide a difference of roughly 0.5% between the peripheral velocity of a photosensitive drum and the moving speed of the intermediary transfer belt 24 when transferring a toner image onto the intermediary transfer belt 24, and also, between the moving speeds of the intermediary transfer belt 24 and the speed at which a sheet of recording medium is conveyed. In other words, it is common practice to make a medium onto which a toner image is transferred slide by a minuscule amount on a medium from which the toner image is transferred. Here, however, it is assumed that the amount by which a medium onto which a toner is transferred slips against a medium from which the toner image is transferred is zero, and the four monochromatic toner images formed on the photosensitive drums 12*a*, 12*b*, 12*c*, and 12*d*, one for one, are the same in dimension in terms of the recording medium conveyance direction, and are transferred onto the intermediary transfer belt 24 without changing in size.

Referring to FIGS. 3 and 13, the electrostatic alignment code 31*a* is transferred from the photosensitive drum 12*a* onto the electrostatic image recording track 25 of the intermediary transfer belt 24 at the same time as a toner image, which is to be transferred onto an A4 size sheet of recording medium (which is to be conveyed so that its lengthwise edges become perpendicular to recording medium conveyance direction) is transferred onto the intermediary transfer belt 24. More specifically, in the image forming station 43*a*, two toner images, which correspond to two pages of recording medium, are transferred in succession onto the intermediary transfer belt 24.

It is not that each image (combination of toner image and blank area) is large enough to cover the entirety of each sheet P of recording medium. In other words, each image is of such a size that as it is transferred onto a sheet P of recording medium, a preset amount of margin will be created along the front, rear, left, and right edges of the sheet P. Therefore, the image is smaller than a sheet P of recording medium. The margins at the leading and trailing edges of the sheet P are 2.5 mm in terms of the recording medium conveyance direction, and the left and right margins are 2 mm in terms of the direction perpendicular to the recording medium conveyance direction.

Thus, when an image is formed on the photosensitive drum 12*a*, and the size of the image corresponds to a sheet P of recording medium which corresponds to a single page, the peripheral surface of the photosensitive drum 12*a* begins to be exposed from the theoretical line on the peripheral surface of the photosensitive drum 12*a*, which corresponds to the leading edge of the sheet P of recording medium, whereas the electrostatic alignment codes 31*a* begin to be formed on the lengthwise end portions of the photosensitive drum 12*a*, 2.5 mm downstream in terms of the rotational direction of the photosensitive drum 12*a*.

When the image forming apparatus 1 is operated at a resolution of 1,200 dpi, the scanning pitch of the beam of laser light is 0.02115 mm (=25.4 mm÷1200). Thus, in order to form an electrostatic alignment code which is smallest in pitch, the peripheral surface of the photosensitive drum 12*a* is exposed in such a manner that the beam of laser light exposes the peripheral surface of the photosensitive drum 12*a* at every other scanning line. Thus, the electrostatic alignment code 31*a* (made up of alternately placed high and potential bars, each of which is equivalent in width to a single scanning line, in terms of recording medium conveyance direction). In this case, the electrostatic alignment code 31*a* is 42.3 μm in pitch.

Incidentally, if it is wanted to form an electrostatic alignment code which is the same in resolution as the image to be formed as described above, all that is necessary is to use the aforementioned method for graduating an electrostatic alignment code. With the use of this method, it is possible to form various electrostatic alignment codes, for example, an electrostatic alignment code made up of alternately placed high and low potential bars, the width of which corresponds to two scanning lines, eight scanning lines, etc.

Next, referring to FIG. 14, in order to ensure that the leading end of the electrostatic alignment code 31*b* perfectly aligns with the electrostatic alignment code 32 on the intermediary transfer belt 24 in the image forming station 43*b*, the following control was executed. That is, when forming an image, the size of which corresponds to a single page of recording medium, the electrostatic alignment code 32 is formed so that the portion of the electrostatic alignment code 32, which corresponds in position to the leading end margin, becomes greater in pitch than the rest. More specifically, when forming an electrostatic image (electrostatic alignment code 31*a*) of the electrostatic alignment code 32 on the peripheral surface of the photosensitive drum 12*a*, the first bar of the electrostatic alignment code 31*a* is formed on the lengthwise end portions of the photosensitive drum 12*a* so that it aligns with the leading edge of the front margin of the image, and then, four low potential bar are formed at a pitch of 338.4 μm, which is eight times the normal pitch of the electrostatic alignment code 31*a*, that is, the pitch of the portion of the electrostatic alignment code 31*a*, which corresponds in position to the actual image formation area of the peripheral surface of the photosensitive drum 12*a*. Then, three low potential bars, are formed at a pitch of 169.2 μm, which is half the pitch of the preceding four low potential bars. Then, three low potential bars are formed at a pitch of 88.46 μm, which is half the pitch of the immediately preceding three low potential bars. Thereafter, low potential bars are momently formed at a pitch of 42.3 μm, or the normal pitch, until the trailing edge of the rear margin of the image arrives.

Thus, the area of each of the lengthwise end portions of the peripheral surface of the photosensitive drum 12, which corresponds in position to the front margin of the electrostatic latent image of the image to be formed, and across which low potential bars are formed at various pitches which is greater than the pitch at which low potential bars are formed across the portion of the electrostatic alignment code formation areas of the peripheral surface of the photosensitive drum 12*a*, is shorter in terms of the rotational direction of the photosensitive drum 12*a* than 2.5 mm which is the dimension of the front margin portion:

$$0.3384\times3+0.1692\times3+0.0846\times3+1.0152+0.5076+0.2538=1.7766 \text{ mm.}$$

Also on the photosensitive drum 12*b*, an electrostatic alignment code 31*b* is begins to be formed so that its portion which corresponds in position to the front margin of a print becomes eight times in pitch compared to its normal pitch, that is, the pitch which corresponds to the image formation area of the peripheral surface of the photosensitive drum 12*b*, and then, the following portions are gradually reduced in pitch to four times the normal pitch, two times the normal pitch, and to the normal pitch.

In the case of the image forming apparatus 1 used for the experiment, the maximum amount of the positional deviation of an image in terms of the recording medium conveyance direction was 150 μm. Thus, it was assumed that the maximum amount of misalignment between the electrostatic alignment code 32 on the intermediary transfer belt 24 and the electrostatic alignment code 31*b* on the photosensitive drum 12*b* was also 150 μm. Since the portion of the electrostatic alignment code 31*a*, which corresponds in position to the front margin of a print, is formed so that the low potential bar pitch becomes 338.4 μm. Therefore, even when the maxim amount of positional deviation of an image is 150 μm, it is ensured that the misalignment between the electrostatic alignment code 32 on the intermediary transfer belt 24 and the electrostatic alignment code 31*b* on the photosensitive drum 12*b* can be detected at the scanning line level of accuracy.

Referring to FIG. 15, in the first transfer area of the image forming station 43*b*, the maximum amount of the positional deviation between the electrostatic alignment code 31*b* and electrostatic alignment code 32 is 150 μm. Therefore, it is ensured that after one of the low potential bars of either electrostatic alignment code is detected, a low potential bar of the other electrostatic alignment code is detected before another low potential bar of the first electrostatic alignment code is detected. In other words, the low potential bar of one of the electrostatic alignment codes and the corresponding low potential bar of the other electrostatic alignment code are alternately detected. Therefore, each time the electrostatic alignment code 31*b* is detected, the rotational speed of the photosensitive drum 12*b* is adjusted so that the electrostatic alignment code 31*b* aligns with the electrostatic alignment code 32. Further, since the pattern of each electrostatic alignment code is such that the graduation pitch is the largest across the upstream portion of the electrostatic alignment code, which corresponds to the front margin of a print, and gradually reduces toward the portion of the electrostatic alignment code, which corresponds to the actual image portion of the print. Therefore, the operation to align the electrostatic alignment code 31*b* with the electrostatic alignment code 32 continues without the problem that the potential sensor 330 fails to detect the electrostatic alignment code, until the arrival of the image formation area of the peripheral surface of the photosensitive drum 12*b*.

It is assumed here that the first low potential bar of the electrostatic alignment code 31*b* did not align with the first low potential bar of the electrostatic alignment code 32 in the first transfer area in the image forming station 43*b*, and the amount of misalignment is 0.150 mm. In order to align the two first low potential bars, the motor for rotating the photosensitive drum 12*b* is changed in rotational speed by the amount proportional to the amount of the misalignment between the two first low potential bars. However, the initial amount of the misalignment is too large for the second low potential bar of the electrostatic alignment code 31*b* to be aligned with the second low potential bar of the electrostatic alignment code 32 by the adjustment of the rotational speed of the motor for driving the photosensitive drum 12. Thus, the amount of the misalignment between the two second potential bars is detected, and the motor for driving the photosensitive drum 12*b* is changed in rotational speed by the amount proportional to the amount of the misalignment. As this procedure is continued to control the rotational speed of the photosensitive drum 12*b*, it eventually occurs that one of the subsequent low potential bars of the electrostatic alignment code 31*b* aligns with the corresponding low potential bar of the electrostatic alignment code 32, in the first transfer area. From this point on, the low potential bars (alignment marks) of the electrostatic alignment code 31*b* remain aligned with the corresponding alignment marks of the electrostatic alignment code 32, even through they are smaller in pitch than those in the preceding portions of the electrostatic alignment codes 31*b* and 32.

Through the above described control sequence, the image (combination of toner image and blank areas) on the photosensitive drum 12*b* can be transferred (layered) onto the image (combination of toner image and blank areas) on the intermediary transfer belt 24, in the first transfer area of the image forming station 43*b*, so that the two images perfectly align with each other. That is, the monochromatic images on the photosensitive drums 12*b*, 12*c*, and 12*d* can be transferred (first transfer) in layers on the yellow monochromatic image so that the resultant multicolor image suffers from little color deviation.

Next, referring to FIG. 16, in the first image forming station 43*a*, the electrostatic alignment bar code 31*a*, as an example of first electrostatic alignment bar code, is written on the areas of the peripheral surface of the photosensitive drum 12*a*, which are outside the toner image development area in terms of the lengthwise direction of the photosensitive drum 12*a*, with the use of the exposing device 16*a*, as an example of first image writing means for forming an electrostatic image of the image to be formed. In the second image forming station 43*b*, the electrostatic alignment bar code 31*b*, as an example of second electrostatic alignment bar code, is written on the areas of the peripheral surface of the photosensitive drum 12*b*, which are outside the toner image development area in terms of the lengthwise direction of the photosensitive drum 12*a*, with the use of the exposing device 16*b*, as an example of second image writing means for forming an electrostatic image of the image to be formed.

The drum bar code reading sensor 34*b* and belt bar code reading sensor 33*b* as examples of a bar code detecting means detect electrostatic alignment bar codes 31*b* and 32 in the second image forming station 43*b*. The control 48 as an example of controlling means controls the drum driving motor 6*b* based on the result of the detection of the image alignment bar code 31*b* on the photosensitive drum 12*b* and the image alignment bar code 32 on the intermediary transfer belt 24 by the bar code reading sensors 34*b* and 33*b*, respectively. Therefore, the toner image on the photosensitive drum 12*b* is transferred onto the intermediary transfer belt 24 in virtually perfect alignment with the yellow toner image on the intermediary transfer belt 24, which has just been transferred onto the intermediary transfer belt 24.

Referring to FIG. 17, as the control 48 receives a printing start signal (S1), it activates the drum driving motors 6*a* and 6*b*, and the unshown belt driving motor (S2). The control 48 controls the drum driving motors 6*a* and 6*b*, while reading the signals from a drum encoder 8*a* and 8*b*, so that the motors 6*a* and 6*b* rotate in the direction indicated by the arrow mark R1 at a constant rotational speed. Similarly, the control 48 controls the belt driving motor so that the belt driving motor rotates at a constant speed. Thus, the intermediary transfer belt 24 is circularly moved in the direction indicated by the arrow mark R2 at a constant speed.

Next, the control 48 applies oscillatory voltages to the charge rollers 14*a* and 14*b*, charging thereby the peripheral surface of each of the photosensitive drums 12*a* and 12*b* to −600 V, for example. Further, it applies preset voltages the first transfer rollers 4*a* and 4*b*, and electrostatic alignment code transfer roller 47 (S3).

Next, as the control 48 receives image formation signals, it makes the exposing device 16*a* start an exposing operation (S4). More specifically, it makes the exposing device 16*a* to form the electrostatic alignment code 31*a* for image alignment (which is preset in pitch), starting from a theoretical line on the peripheral surface of the photosensitive drum 12*a*, which corresponds in position to the front edge of the front margin of a print to be made, as described above. Then, even after the exposing operation for forming a toner image based on image formation data is started, the exposing operation for forming the electrostatic alignment code 31*a* for image alignment is continued until the exposing operation for forming the image for the first page is ended.

Next, the control 48 checks whether or not 0.8333333 second has passed since the starting of the exposing operation by the exposing device 16*a*. If it determines that 0.8333333 second has passed (Yes in S5), it makes the exposing device 16*b* start an exposing operation (S6). In this embodiment, the diameter of each photosensitive drum 12 is 84 mm, and the image formation station pitch (distance between image forming station 43*a* and 43*b*) is 250 mm. Further, the exposure-transfer distance, that is, the distance from the point at which the peripheral surface of the photosensitive drum 12 is exposed, to the point at which a toner image is transferred from the photosensitive drum 12 onto the intermediary transfer belt 24, is 125 mm, and the process speed is 300 mm/sec. Further, 0.8333333 second equals the theoretical length of time it takes for a given point of the intermediary transfer belt 24 to be moved from the point at which a toner image is transferred from the photosensitive drum 12*a* onto the intermediary transfer belt 24, to the point at which a toner image is transferred from the photosensitive drum 12*b* onto the intermediary transfer belt 24.

Next, the control sets "i" to zero (i=0) (S7). Then, it detects the i-th (I=0) bar of the electrostatic alignment code either by the sensor 33*b* for reading the electrostatic alignment code on the intermediary transfer belt 24 or the sensor 34*b* for reading the electrostatic alignment code on the drum 12*b* (S8*a*, S8*b*).

Next, the control 48 calculates the difference Δi in time between when the first bar of the electrostatic alignment code on the photosensitive drum 12*b* was detected, and when the first bar of the electrostatic alignment code on the intermediary transfer belt 24 was detected (S9). Then, it compares the difference Δi with the value obtained by dividing the pitch Pi of the electrostatic alignment bar code by the process speed (300 mm/sec) (S10).

Then, based on the amount of difference Δi, the control 48 calculates the amount by which the speed of the drum driving motor 6*b* of the image forming station 43*b* is to be adjusted in order to reduce the positional deviation between the electrostatic alignment code on the photosensitive drum 12*b* and the electrostatic alignment code on the intermediary transfer belt 24 to zero (S12). Then, the control 48 adjusts the rotational speed of the drum driving motor 6*b* by the calculated amount for adjusting the drum driving motor speed (S13). Then, the control 48 repeats the above described process for adjusting the drum driving motor 6*b* in rotational speed, so that the portion of the electrostatic alignment code on the photosensitive drum 12*b*, which is smallest in pitch, virtually perfectly aligns with the portion of the electrostatic alignment code on the intermediary transfer belt 24, which is smallest in pitch, by the time the image formation area of the peripheral surface of the photosensitive drum 12*b* arrives.

Next, the control 48 repeats the above described process of controlling the drum driving motor 6*b* until the image for the first page is completed based on the image formation data (No in S15). As soon as the first image is completed (Yes in S15), the control 48 stops the exposing operation (S16).

Next, if the control 48 detects the presence of the image formation data for the next page (Yes in S17), it repeats the same operation as it did for the first page (S4-S17). Then, if it determines that there is no image formation data (No in S17), it stops applying voltage to the charge roller 14*a*, first transfer roller 4*a*, and electrostatic alignment code transfer roller 47 (S18). Then, it keeps on rotating the photosensitive drum 12*b* and intermediary transfer belt 24 until the transfer (second transfer) of the toner image on the photosensitive drum 12*a* is completed (No in S19). Then, as soon as the image transfer from the photosensitive drum 12*b* onto the intermediary transfer belt 24 is completed (Yes in S19), the control 48 stops driving the photosensitive drum 12*a* and intermediary transfer belt 24 (S20), and ends the printing operation (S21).

Incidentally, as described previously with reference to FIG. 15, it is assumed that before the second bar of one of the electrostatic alignment codes is detected, one of the bars of the other electrostatic alignment code is to be detected. However, if Δi is smaller than the value of Pi/300 m/sec (Yes in S10), the first bar of the second electrostatic alignment code is detected before the second bar of the first electrostatic alignment code. Therefore, it is assured that the first bar of the first electrostatic alignment code is matched with the first bar of the second electrostatic alignment code.

However, if Δi is larger than the value of Pi/300 m/sec (No in S10), the first bar of the second electrostatic alignment code is not detected before the second bar of the first electrostatic alignment code. Therefore, it cannot be assured that the first bar of the first electrostatic alignment code is matched with the first bar of the second electrostatic alignment code. Thus, it is impossible for the control 48 to properly control the drum driving motor 6*b*. Thus, the control 48 determines that for some reason, a large amount of slippage is occurring between the belt driving roll 36 and intermediary transfer belt 24. Therefore, it determines that an operational error has occurred, and stops the operation of the image forming apparatus 1 (S11).

The control 48 executes such a control that as the electrostatic alignment codes 31*b*, 31*c*, and 31*d* for image alignment are transferred onto the intermediary transfer belt 24 in the image forming station 43*b*, 43*c*, and 43*d*, respectively, they align, in terms of the direction perpendicular to the surface of the intermediary transfer belt 24, with the electrostatic alignment code 32 on the intermediary transfer belt 24, which was formed on the intermediary transfer belt 24 by transferring the electrostatic alignment code 31*a* for image alignment from the photosensitive drum 12*a* onto the intermediary transfer belt 24. Thus, when the toner images formed on the photosensitive drums 12*b*, 12*c*, and 12*d* in the image forming station 43*b*, 43*c*, and 43*d*, respectively, are transferred onto the intermediary transfer belt 24, they are highly precisely layered in alignment, onto the first toner image on the intermediary transfer belt 24, that is, the toner image from the photosensitive drum 12*a*. Therefore, the image forming apparatus 1 in this embodiment can output high quality images, more specifically, images which are free from color deviation.

In the case of the image forming apparatus described above, an electrostatic alignment code for image alignment is formed on the peripheral surface of each of the photosensitive drums, next to the toner image formation area of the photosensitive drum. The control 48 reads the electrostatic alignment code with the use of a potential sensor which converts the pattern of the electrostatic alignment code (bar code, for example) into pulse signals, and controls the rotation of the drum driving motor 6 in response to these pulse signals to align the electrostatic alignment codes on the photosensitive drums with the electrostatic alignment code on the intermediary transfer belt 24. Therefore, the image forming apparatus 1 can high precisely deal with the problem that because the intermediary transfer belt 24 stretches or contracts, the toner images become misaligned when they are transferred onto the intermediary transfer belt 24.

<Embodiment 1>

Referring to FIG. 4, in the first preferred embodiment, the photosensitive drum 12*b* is provided with a pair of grooves 13*b* for providing a space between the pair of potential sensors 33*b* for reading the electrostatic alignment code on the electrostatic image recording track 25, and the electrostatic image recording track 25 and the sensors 33*b* are positioned at the bottom of the grooves 13*b*, one for one. Thus, the sensor 33*b* detects (reads) the electrostatic alignment code 32 on the electrostatic image recording track 25 from the bottom of the groove 13*b*.

The intermediary transfer belt 24 is provided with a pair of electrostatic image recording tracks 25, which are on the outward side (toner image transfer side) of the loop the intermediary transfer belt 24 forms. The tracks 25 are formed of a substance which is high in electrical resistance. They correspond in position to the pair of grooves 13*b* with which the photosensitive drum 12*b* is provided. Thus, the sensor 33*b* for reading the electrostatic alignment code on the electrostatic image recording track 25 is in the space which the groove 13*b* and the track 25 form.

The electrostatic image recording track 25 is 5 mm in width, whereas the groove 13*b* is 9 mm in width, providing thereby a margin of 2 mm on both sides of the electrostatic image recording track 25. Therefore, even if the intermediary transfer belt 24 snakes, it is unlikely for the electrostatic image recording track 25 to come into contact with the photosensitive drum 12*b* as the intermediary transfer belt 24 is steered.

Referring to FIG. 4, the electrostatic alignment code 31*b* is written on the peripheral surface of the photosensitive drum 12*b*, across the outward side (in terms of lengthwise direction of photosensitive drum 12*b*) of the portion of the photosensitive drum 12*b*, which comes into contact with the intermediary transfer belt 24. Further, it is written within the area which can be exposed by the exposing device 16*b*. Further, the electrostatic alignment code 31*b* is formed in the image forming station 43*b* at the same time as an image to be transferred onto the intermediary transfer belt 24 is formed in the image forming station 43*b*.

Next, referring to FIG. 5(*a*), the sensor 34*b* for reading the electrostatic alignment code 31*b* on the drum 12*b* detects (reads) the electrostatic alignment code 31*b* with its potential sensor 330, at a point where the intermediary transfer belt 24 and photosensitive drum 12*b* contact with each other. The sensor 34*b* reads the electrostatic alignment code 31*b* (31*b* in FIG. 4) at a point on the extension of the first transfer area of the image forming station 43*b*, that is, the extension of the area of contact between the photosensitive drum 12*b* and intermediary transfer belt 24, in the direction parallel to the axial line of the photosensitive drum 12*b*.

Next, referring to FIG. 5(*b*), the sensor 33*b* for reading the electrostatic alignment code on the belt intermediary transfer belt 24 reads the electrostatic alignment code 32 (32 in FIG. 15) on the electrostatic image recording track 25, at a point on the extension of the first transfer area (line of transfer) in the direction parallel to the axial line of the photosensitive drum 12*b*. The sensor 33*b* is in the space of the groove 13*b* (small diameter portion), and is kept pressed upon the electrostatic image recording track 25. It detects (reads) the electrostatic alignment code 32, while rubbing the electrostatic image recording track 25, as the electrostatic image recording track 25 is moved relative to the sensor 33*b*. Further, it detects (reads) the electrostatic alignment code 32 with the use of its potential sensor 330 (shown in FIG. 7(*b*)), at a point on the extension of the line of contact between the intermediary transfer belt 24 and photosensitive drum 12*b*.

Therefore, in the image forming station 43*b*, the sensor 33*b* for reading the electrostatic alignment code on the intermediary transfer belt 24, and the sensor 34*b* for reading the electrostatic alignment code on the photosensitive drum 12*b*, are on the same straight line. Thus, the electrostatic alignment code 31*b* and electrostatic alignment code 32 are read at the same time.

The electrostatic alignment code 31*a* and electrostatic alignment code 31*b* are made up of electrostatic bars positioned with preset intervals. The amount of the preset interval corresponds to a preset number of scanning lines of the exposing device 16*b*. Referring to FIG. 7(*a*), the potential sensor 330 has a part 331 of an electrically conductive wire. The part 331 is positioned a preset distance away from the surface of the potential sensor 330, which comes into contact with the electrostatic alignment code on the electrostatic image recording track 25. Further, it is positioned so that when the sensor 33*b* is positioned to read the electrostatic alignment code (32 in FIG. 13) on the electrostatic image recording track 25, it is parallel to the electrostatic bars of the electrostatic alignment code. More concretely, the potential sensor 330 comprises: the part 331 of an electrically conductive wire; and a resilient and electrically nonconductive sheet, which rubs against the electrostatic image recording track 25 (electrostatic alignment code 32), and to which the conductive wire is solidly attached. The sensor 31*b* is of the so-called antenna type, which detects the electric current induced in the part 331 of the conductive wire as the electrostatic image recording track 25 is moved relative to the potential sensing portion of the sensor 31*b*.

In the first preferred embodiment, the sensors are positioned on the straight extension of the first transfer area (line of transfer). Thus, they can make it possible for the photosensitive drum 12*b* to be changed in speed, in such a manner that each electrostatic bar of the electrostatic alignment code 31*b* is aligned with the corresponding electrostatic bar of the electrostatic alignment code 32, which is fluctuating in speed. Therefore, the toner image on the photosensitive drum 12*b* can be aligned with the toner image on the intermediary transfer belt 24 with accuracy that each scanning line of the image on the photosensitive drum 12*b* aligns with the corresponding scanning line of the toner image on the intermediary transfer belt 24 with the same accuracy as the accuracy with which the electrostatic alignment code 31*b* is aligned with the electrostatic alignment code 32. Thus, the color deviation attributable to the misalignment between a yellow toner image and a magenta toner image can be prevented at the level of a scanning line.

Further, the potential sensor 330 is very simple in structure. That is, it is made up of a resilient substrate, and an L-shaped piece of electrically conductive wire attached to the surface of the substrate. Therefore, it is very low in manufacturing cost, and yet, it can read each of the electrostatic bars of the electrostatic alignment codes. Thus, it is unnecessary for the image forming apparatus 1 to be provided with a magnetic head, an optical head, or the like, which is for reading the code (bar code, for example) for image alignment. Therefore, the accuracy with which toner images are aligned with each other is not affected by the errors which occur when a magnetic head, an optical head, or the like are attached. In other words, this embodiment of the present invention can provide an image forming apparatus which is not only accurate, but also, low in cost.

<Embodiment 2>

Figure 18:
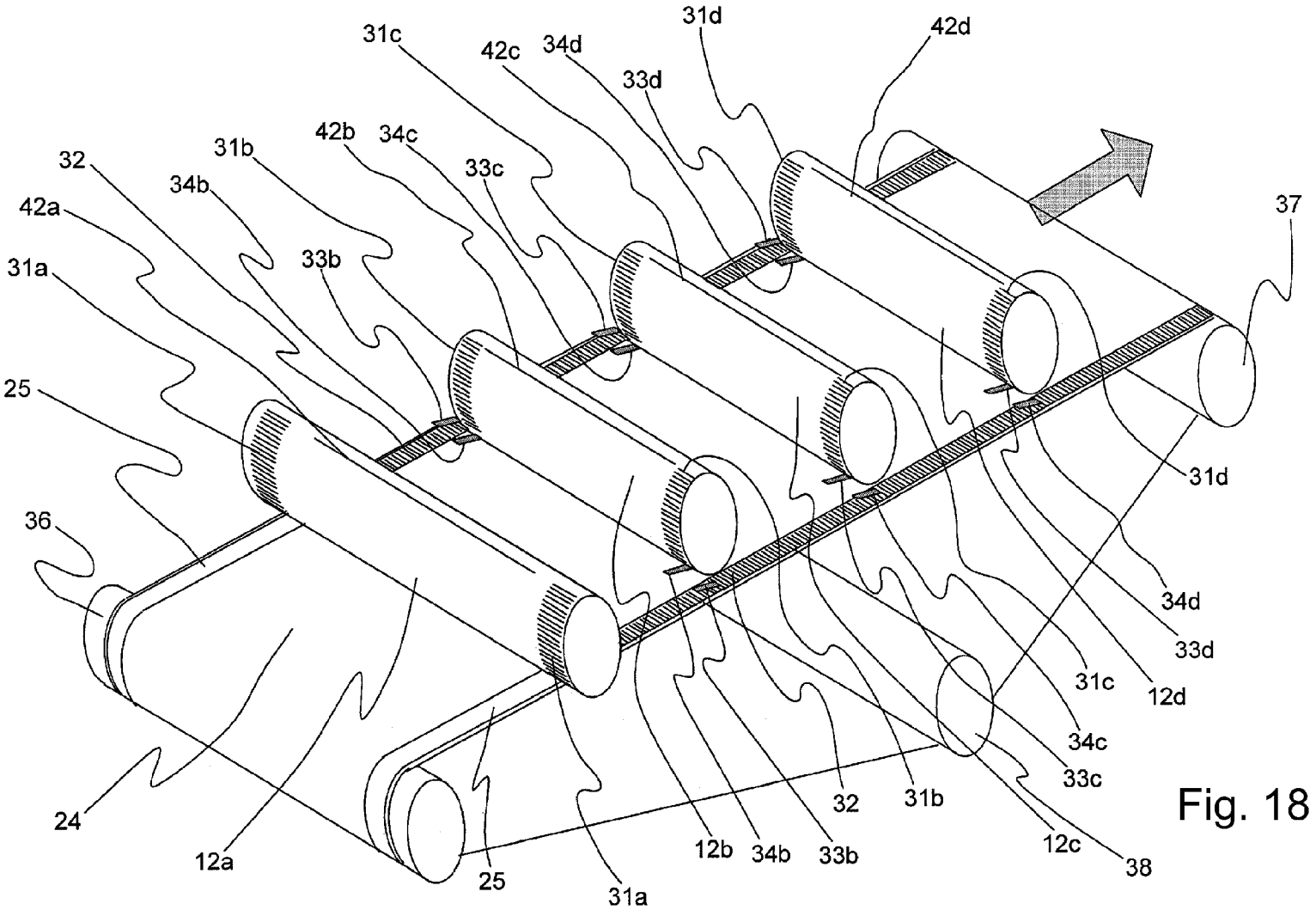
FIG. 18 is an illustration of an arrangement of an electrostatic image recording track and a potential sensor in Embodiment 2.
Figure 19:
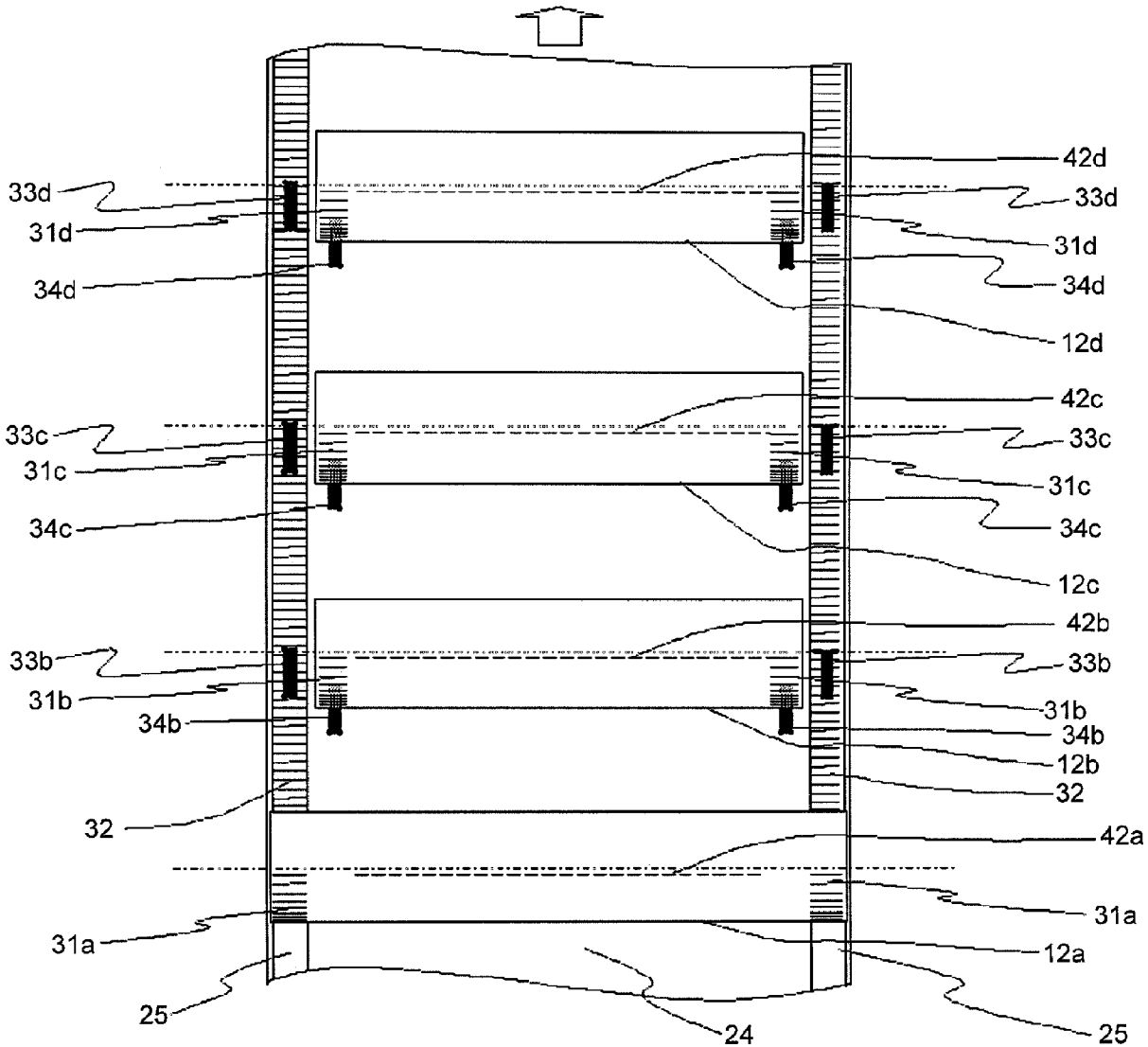
FIG. 19 is an illustration of the disposition of the electrostatic image recording track according to Embodiment 2.

FIG. 18 is a drawing for describing the positioning of the electrostatic image recording track and potential sensor in the second preferred embodiment of the present invention. FIG. 19 is a drawing for describing the positioning of the electrostatic image recording track in the second embodiment. Referring to FIG. 18, in the second embodiment, the photosensitive drum 12*b* is not provided with a pair of small diameter portions 13*b* (grooves), in which the sensor 33*b* for reading the electrostatic alignment code on the image recording track on the intermediary transfer belt 24 is positioned. However, the sensor 34*b* for reading the electrostatic alignment code on the photosensitive drum 12*b* is positioned on the immediately upstream side of the first transfer area where the photosensitive drum 12*b* contacts the intermediary transfer belt 24, in terms of the moving direction of the intermediary transfer belt 24. Otherwise, this embodiment is the same in structure and control as the first embodiment. Thus, the portions of the photosensitive drums 12 and intermediary transfer belt 24 in FIGS. 18 and 19, which are the same as the counterparts in the first embodiment, are given the same referential codes as those given in FIGS. 2-5, and are not going to be described here.

Referring to FIG. 19, the intermediary transfer belt 24 is provided with a pair of electrostatic image recording tracks 25, which are on the outward side (toner image transfer side) of the loop the intermediary transfer belt 24 forms. The tracks 25 are formed of a substance which is high in electrical resistance. The photosensitive drums 12*b*, 12*c*, and 12*d* in the image forming station 43*b*, 43*c*, and 43*d*, respectively, are smaller in length than the distance between the pair of electrostatic image recording tracks 25 with which the widthwise end portions of the intermediary transfer belt 24 are provided one for one.

The sensors 33*b*, 33*c*, and 33*d* for reading the electrostatic alignment code on the intermediary transfer belt 24 are the same as those in the first embodiment. In terms of the direction parallel to the axial lines of the photosensitive drums 12*b*, 12*c*, and 12*d*, the sensors 33*b*, 33*c*, and 33*d* are on the extension of the center line of the corresponding transfer areas, and are outside the ranges of the photosensitive drums 12*b*, 12*c*, and 12*d*, respectively. The sensors 33*b*, 33*c*, and 33*d* read the electrostatic alignment code 32 at the point which is in alignment with the center line of the first transfer area. The electrostatic alignment code 32 is the electrostatic alignment code formed on the intermediary transfer belt 24 by transferring the electrostatic alignment code 31*a* onto the electrostatic image recording track 25 on the intermediary transfer belt 24.

As for the sensors 34*b*, 34*c*, and 34*d* for reading the electrostatic alignment codes 31*b*, 31*c*, and 31*d* on the photosensitive drums 12*b*, 12*c*, and 12*d*, respectively, are positioned slightly upstream of the corresponding first transfer areas, in terms of the moving direction of the intermediary transfer belt 24, without being placed in contact with the intermediary transfer belt 24. In the image forming station 43*b*, the electrostatic alignment code 31*b* is written by the exposing device 16*b*, on the peripheral surface of the photosensitive drum 12*b*, across the areas which are outside the actual image forming area, and are in alignment with the actual image forming area in terms of the lengthwise direction of the photosensitive drum 12*b*. The sensor 33*b* for reading the electrostatic alignment code 32 written on the electrostatic image recording track 25 of the intermediary transfer belt 24 is positioned on or near (no farther than 10 mm) the extension of the first transfer area (line of first transfer).

According to the second embodiment, it is unnecessary to provide the photosensitive drums 12 with the pair of small diameter portions (13*b* in FIG. 2) as in the first embodiment. Yet, the electrostatic alignment code 32 on the electrostatic image recording track 25 can be read at a point which is slightly offset from the first transfer area, but is virtually the same in position as the first transfer area.

Referring also to FIG. 19, in the image forming station 43*b*, the electrostatic alignment code 31*b* is written on the photosensitive drum 12*b*, across the area which is outside the image formation area, and within the area which can be exposed by the exposing the exposing device 16*b*. Therefore, it is possible to reduce the exposing device 16 in the scanning range of its beam of laser light. In other words, the second embodiment can reduce in size the exposing devices 16*b*, 16*c*, and 16*d* of the image forming station 43*b*, 43*c*, and 43*d*, respectively.

<Embodiment 3>

Figure 20:
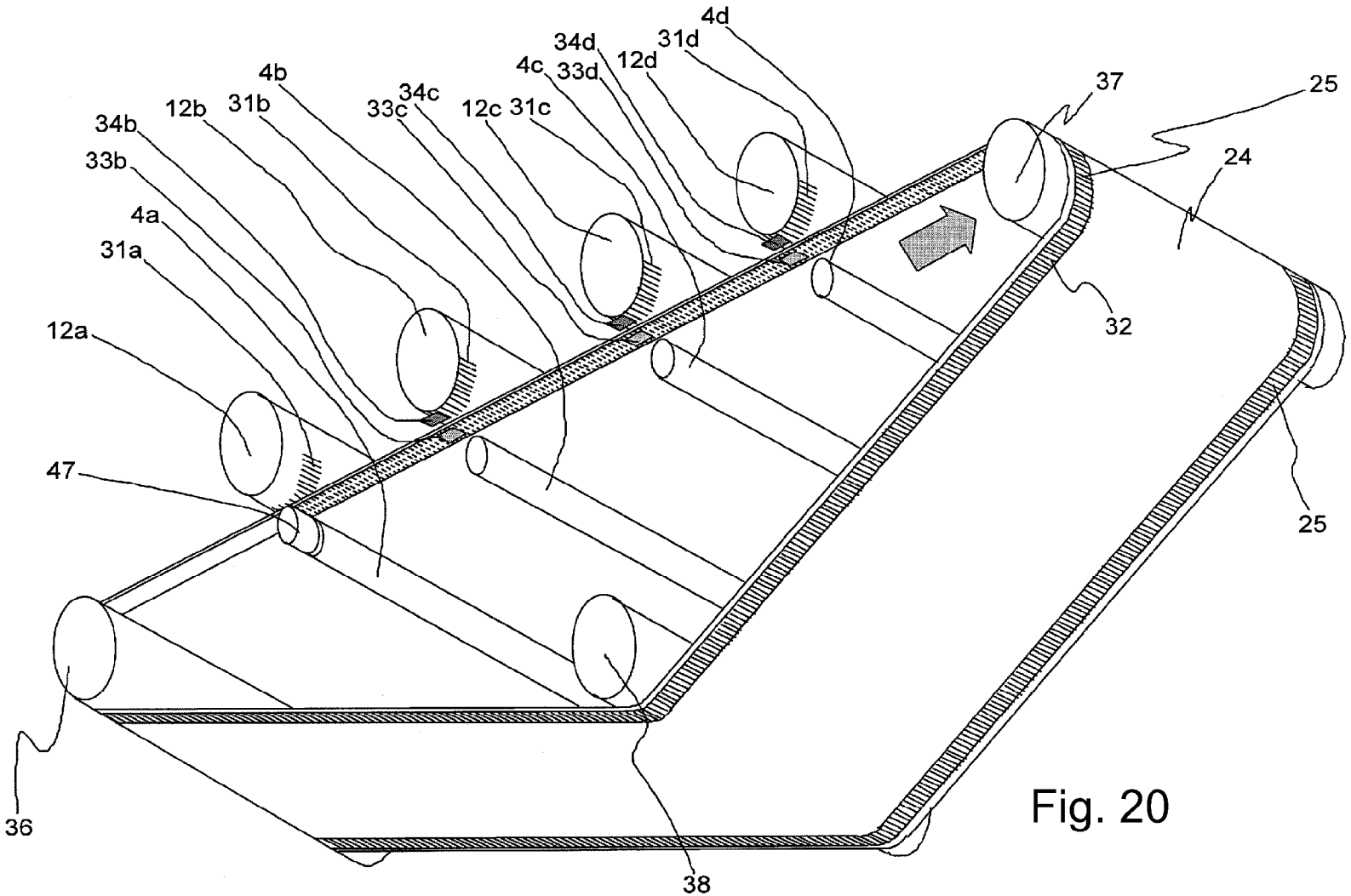
FIG. 20 is an illustration of an arrangement of an electrostatic image recording track and a potential sensor in Embodiment 2.
Figure 21:
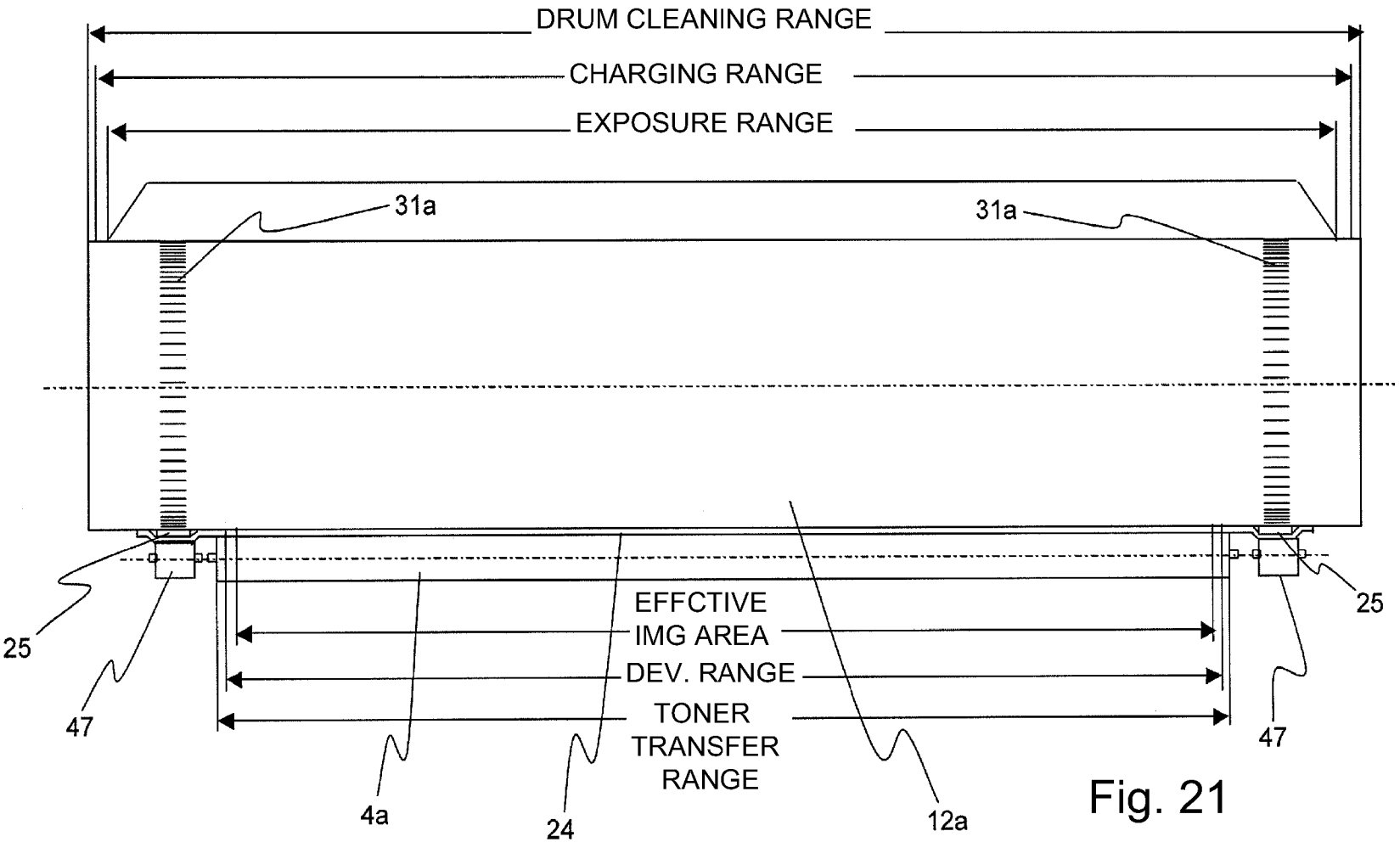
FIG. 21 is an illustration of a transfer portion for the electrostatic image code according to Embodiment 3.
Figure 22:
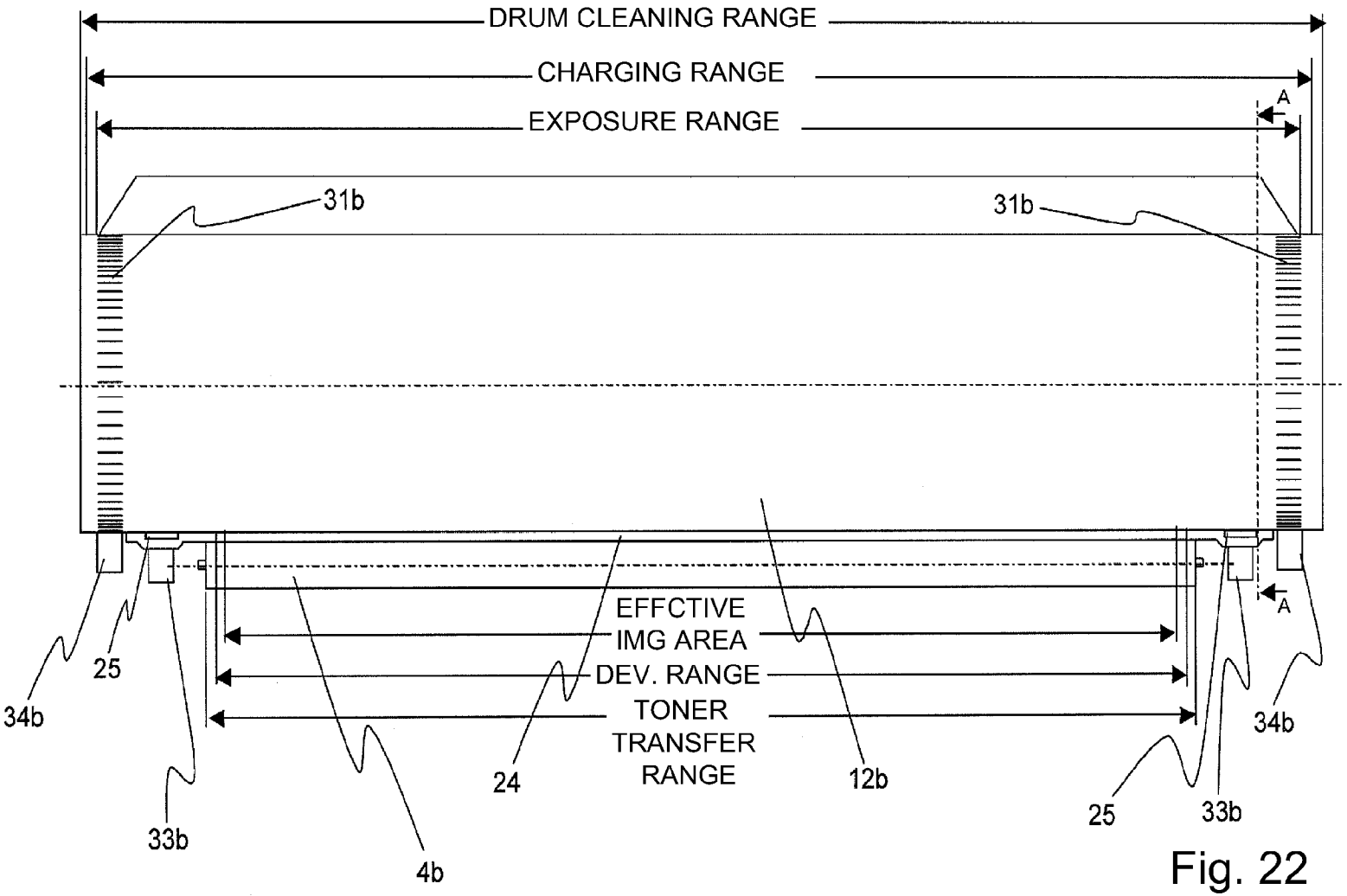
FIG. 22 is an illustration of the detection/alignment the for the electrostatic image code according to Embodiment 3.
Figure 23:
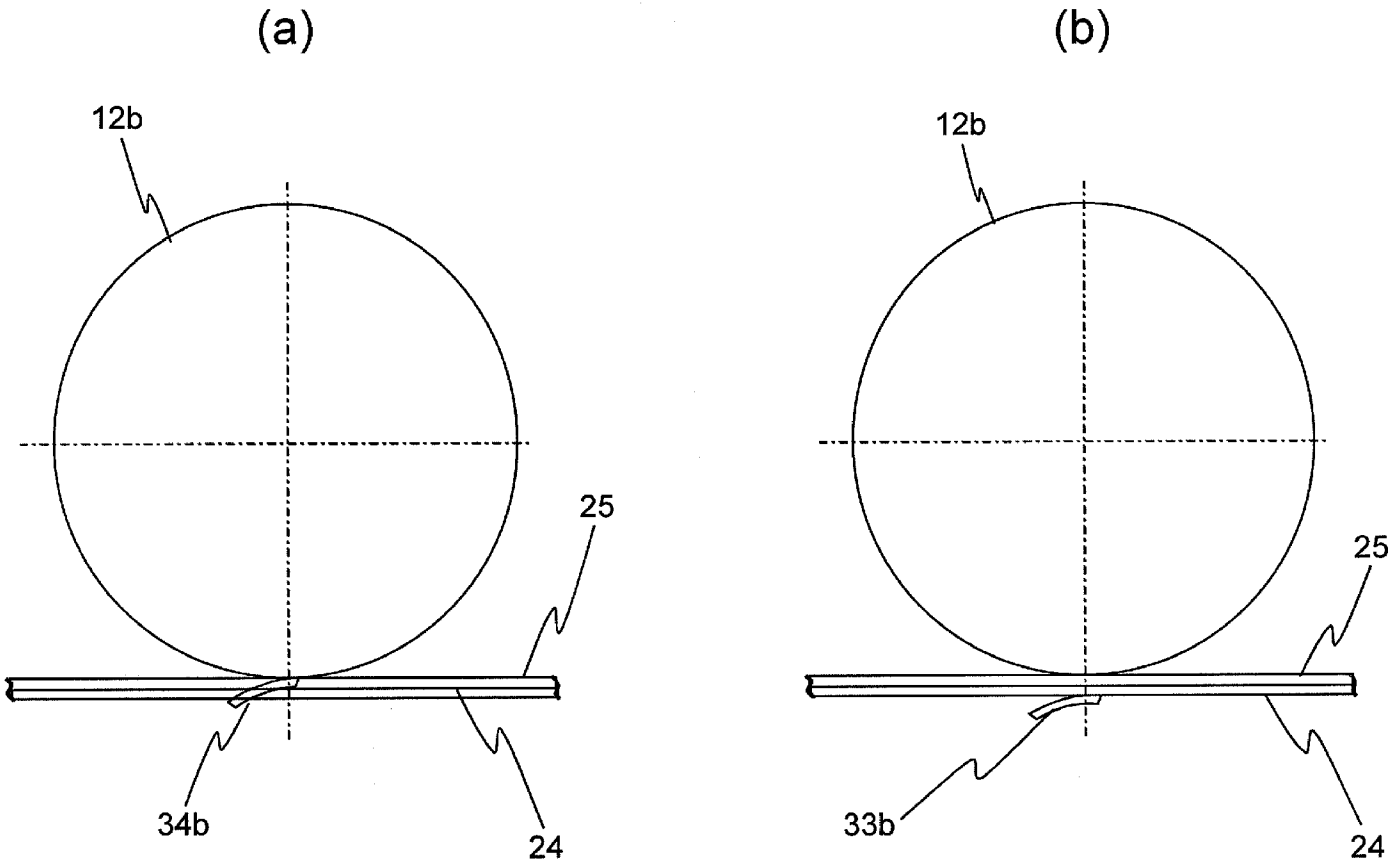
FIG. 23 is an illustration of the disposition of a potential sensor according to Embodiment 3.

FIG. 20 is a drawing for describing the positioning of the electrostatic image recording track and potential sensor in the third preferred embodiment of the present invention. FIG. 21 is a drawing for describing the areas in which electrostatic alignment code is transferred in the third embodiment. FIG. 22 is a drawing for describing the portion of the image forming apparatus in the third embodiment, which detects the electrostatic alignment codes and aligns the electrostatic alignment codes. FIG. 23 is a drawing for describing the potential sensors in the third embodiment.

Referring to FIG. 22, in the image forming station 43*b* in the third embodiment, the sensor 33*b* for reading the electrostatic alignment code on the intermediary transfer belt 24 is positioned on the inward side of the loop which the intermediary transfer belt 24 forms. That is, the electrostatic alignment code 32 on the electrostatic image recording track 25 is detected from the inward side of the intermediary transfer belt 24.

Next, referring to FIG. 23(*a*), the sensor 34*b* for reading the electrostatic alignment code on the photosensitive drum 12*b* reads the electrostatic alignment code 31*b* at a point which is on the extension of the first transfer area (line of first transfer) in the direction parallel to the axial line of the photosensitive drum 12*b*. The first transfer area is where the photosensitive drum 12*b* contacts the intermediary transfer belt 24, and the toner image on the photosensitive drum 12*b* is transferred onto the intermediary transfer belt 24.

Next, referring to FIG. 23(*b*), the sensor 33*b* for reading the electrostatic alignment code on the intermediary transfer belt 24 reads the electrostatic alignment code 32 on the electrostatic image recording track 25 at a point which also is on the extension of the first transfer area in the direction parallel to the axial line of the photosensitive drum 12*b*. Next, referring to FIG. 7(*b*), the sensor 33*b* detects (reads) the electrostatic alignment code (32 in FIG. 13) on the electrostatic image recording track 25, with the use of its potential sensor 330, from the opposite side of the intermediary transfer belt 24 from the surface of the intermediary transfer belt 24, which is in contact with the photosensitive drum 12*b*.

In the image forming station 43*b* in the third embodiment, the sensor 33*b* for reading the electrostatic alignment code on the intermediary transfer belt 24 detects the electrical charge of the electrostatic alignment code 32 on the electrostatic image recording track 25, through the thickness of the combination of the electrostatic image recording track 25 and intermediary transfer belt 24. Therefore, the output signals of the sensor 33*b* are smaller in SN ratio compared to the case in which the electrostatic alignment code on the electrostatic image recording track 25 is detected from the outward surface of the electrostatic image recording track 25 as shown in FIG. 7(*b*). Therefore, the sensor 33*b* is reduced in the resolution with the electrostatic alignment code 32 can be read.

However, the experiment carried out with the use of the image forming apparatus 1 to test the performance of the exposing devices 16*a* and 16*b* in terms of the writing and reading of the electrostatic alignment codes at a resolution of 600 dpi confirmed that the image alignment control described above can be satisfactorily carried by forming electrostatic alignment codes, the bars and spaces (intervals) of which correspond in width to eight scanning lines. In this case, the electrostatic alignment codes 31*b*, 31*c*, and 31*d* are electrostatic alignment codes made up of electrostatic bars which are 691.2 μm in pitch. It was also confirmed by the experiment that even if electrostatic alignment codes are made up of alternately positioned electrostatic bars and spaces (intervals), the width of which corresponds to four scanning lines (345.6 μm in pitch), a voltage that fluctuates in the form of a sine wave can be obtained by the sensor 33*b* for reading the electrostatic alignment code on the intermediary transfer belt 24.

Further, the sensor for reading the electrostatic alignment code 32 on the electrostatic image recording track 25, which was formed by transferring the electrostatic alignment code 31*a* from the photosensitive drum 12*a* onto the intermediary transfer belt 24, is on the inward side of the loop which the intermediary transfer belt 24 forms. Therefore, the surface of the sensor is far less likely to be contaminated by the scattered toner particles or the like. Therefore, this embodiment makes it possible to align toner images at a higher level of reliability.

<Embodiment 4>

Figure 24:
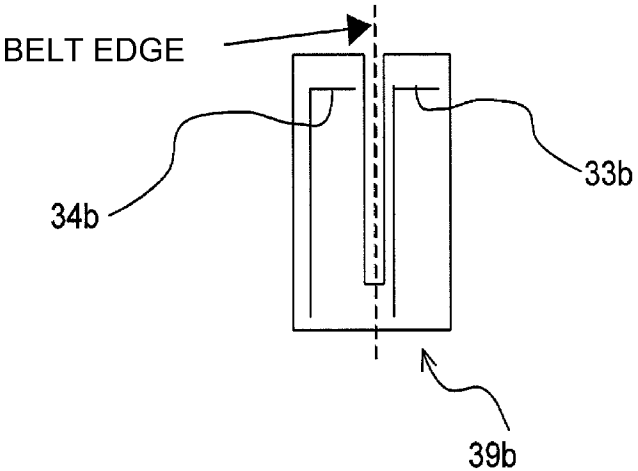
FIG. 24 is an illustration of the structure of a codes reading sensor.
Figure 25:
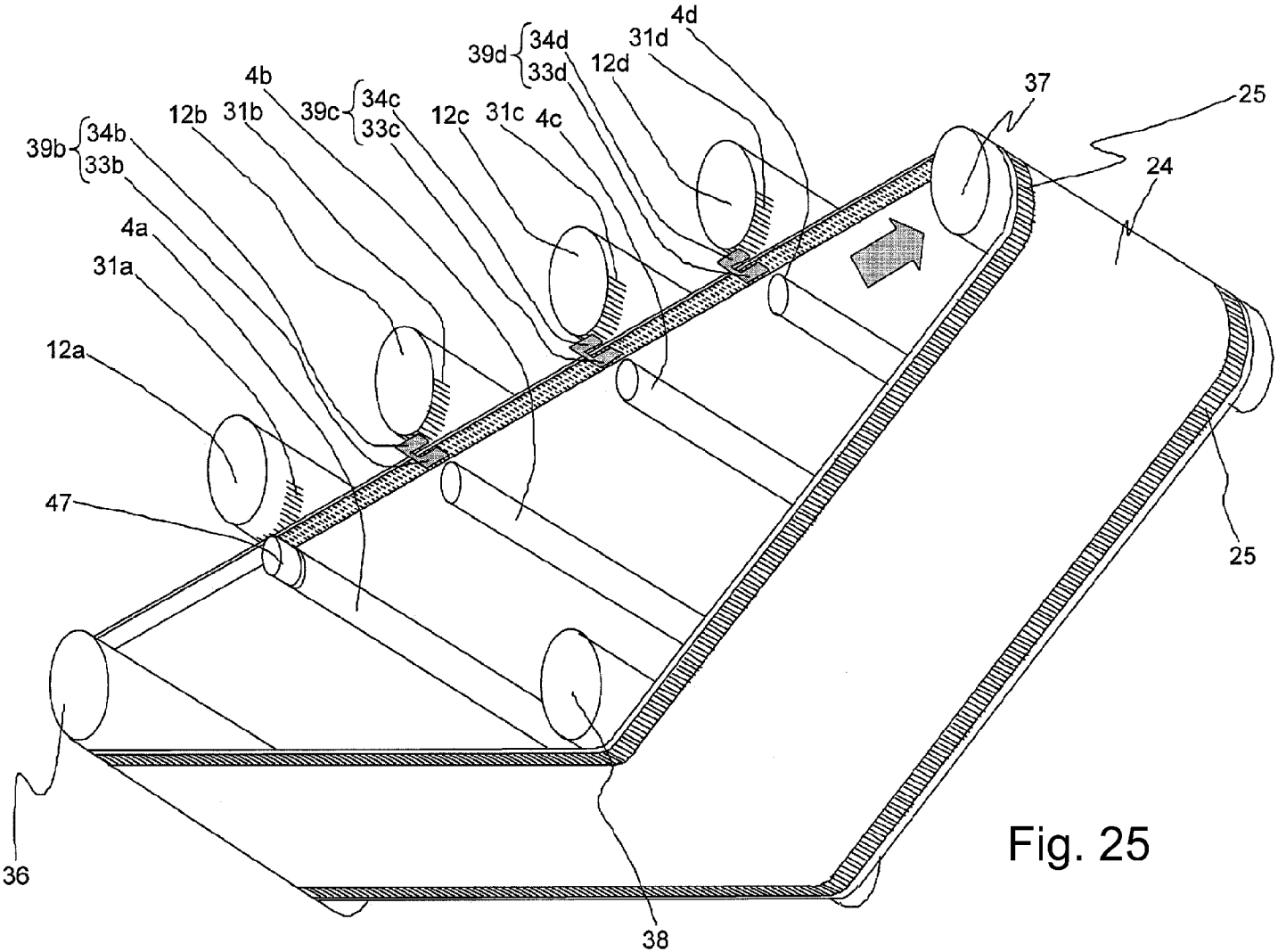
FIG. 25 is an illustration of an arrangement of an electrostatic image recording track and a potential sensor in Embodiment 4.
Figure 26:
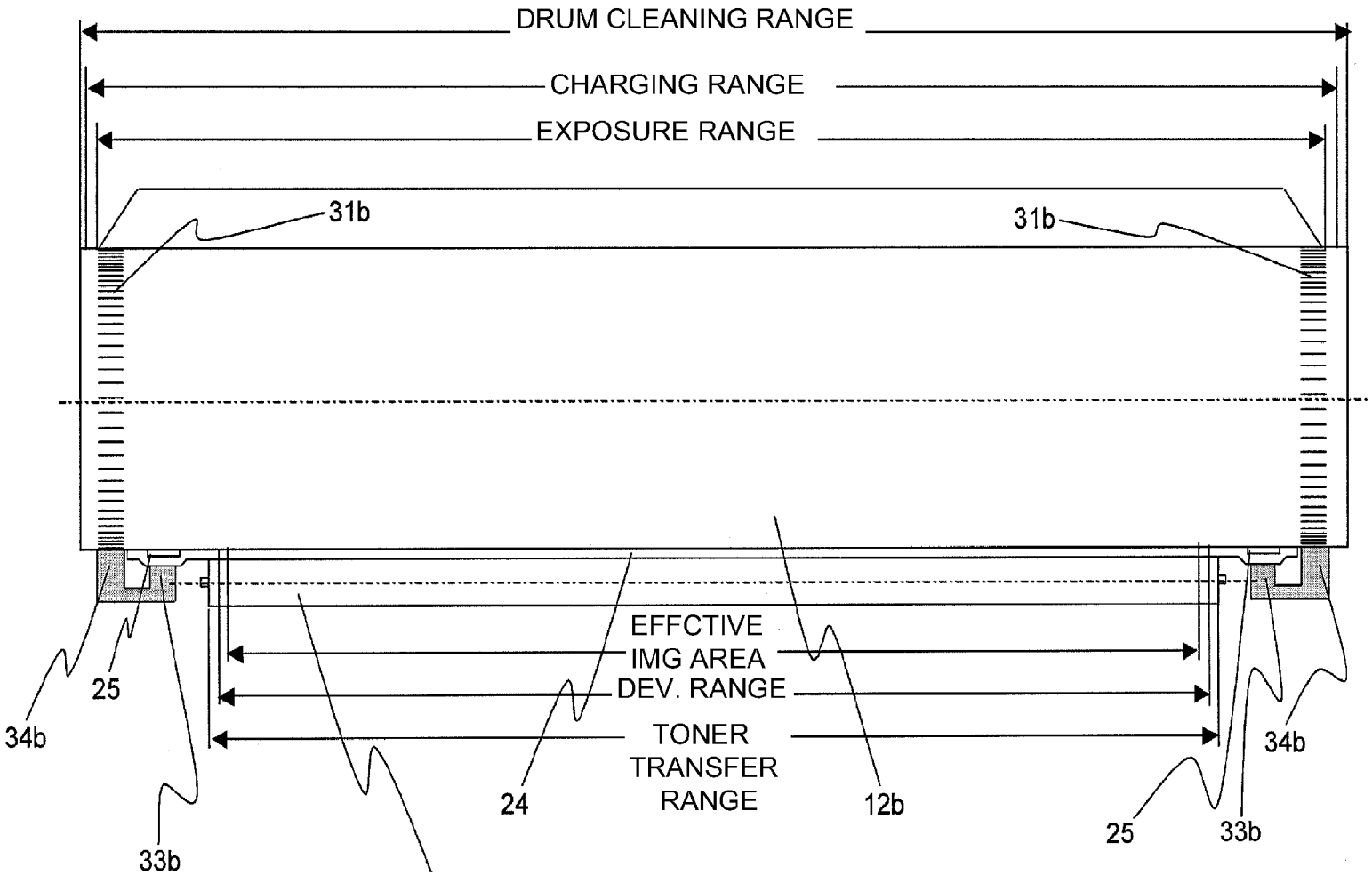
FIG. 26 is an illustration of the detection/alignment the for the electrostatic image code according to Embodiment 4.

FIG. 24 is a drawing for describing the structure of the sensor for reading an electrostatic code (bar code, for example) for image alignment in the fourth preferred embodiment. FIG. 25 is a drawing for describing the positioning of the electrostatic image recording track and potential sensor in the fourth embodiment. FIG. 26 is a drawing for describing the detection (reading) of the electrostatic alignment codes and the alignment between the electrostatic alignment codes and potential sensors, in the fourth embodiment. In the fourth embodiment, the sensor 33 for reading the electrostatic alignment code on the intermediary transfer belt 24 and the sensor 34 for reading the electrostatic alignment code on the photosensitive drum 12 are placed on the same resilient substrate. Otherwise, the fourth embodiment is the same in structure as the third embodiment. Thus, the portions of the image forming apparatus 1 shown in FIGS. 24-26, which are the same in structure as the counterparts in the first embodiment are given the same referential codes as those given to the counterparts, and are not going to be described here.

Referring to FIG. 24, the sensor 39*b* for reading the electrostatic alignment codes has an electrically conductive wire for detecting (reading) the electrostatic alignment code 32, and an electrically conductive wire for detecting (reading) the electrostatic alignment code 31*b*. The substrate of the sensor 39*b* is provided with a groove which extends in the lengthwise direction of the substrate, and the two wires are positioned on the substrate in such a manner that one of the wires is on one side of the groove, and the other is on the opposite side of the groove from the first wire, and also, so that the potential sensing portion of one wire is in alignment with that of the other wire in the direction perpendicular to the lengthwise direction of the substrate. In other words, the sensor 33*b* for reading the electrostatic alignment code on the intermediary transfer belt 24 and the sensor 34*b* for reading the electrostatic alignment code on the peripheral surface of the photosensitive drum 12*b* in this embodiment are parts of the sensor 39*b*, and are positioned so that their potential sensing portions are on the resilient substrate of the sensor 39*b* (which has groove), and are in alignment with the two potential sensing portions of the two wires of the two sensor 33*b* and 34*b*, one for one, are in alignment with each other across the groove. The potential sensing end portion of the sensor 33*b* and the potential sensing end portion of the sensor 34*b* are bent independently from each other, and generate contact pressure between themselves and the electrostatic image recording track 25 (intermediary transfer belt 24).

Referring to FIG. 25, the sensor 39*b* for reading the electrostatic alignment codes contact the electrostatic alignment code 31*b* on the photosensitive drum 12*b*, and the electrostatic alignment code 32 (formed on the electrostatic image recording track 25 by transferring the electrostatic alignment code 31*a* from the photosensitive drum 12*a* onto the electrostatic image recording track 25) on the electrostatic image recording track 25, from the bottom side of the photosensitive drum 12*b* and intermediary transfer belt 24, and rubs the electrostatic alignment code 31*b* (photosensitive drum 12*b*) and the inward surface of the intermediary transfer belt 24.

In the fourth embodiment, the electrostatic alignment code 32 on the intermediary transfer belt 24 and the electrostatic alignment code 31*b* on the photosensitive drum 12*b* are read by the single sensor (39*b*) having both the sensor 33*b* and 34*b*. Therefore, the fourth embodiment can reduce the space for the sensors 33*b* and 34*b* for reading the electrostatic alignment codes. Since the sensor 33*b* for reading the electrostatic alignment code on the intermediary transfer belt 24 and the sensor 34*b* for reading the electrostatic alignment code 31*b* on the photosensitive drum 12*b* are integrated into a single unit (sensor 39*b*) which is smaller in size than the combination of the two independent sensors 33*b* and 34*b*. Thus, the fourth embodiment can reduce the image forming apparatus 1 in size.

Further, the antenna portion of the sensor 33*b* and antenna portion of the sensor 34*b* are on the same resilient substrate. Therefore, the point at which the electrostatic alignment code 31*b* is read by the sensor 34*b* and the point at which the electrostatic alignment code 32 is read by the sensor 33*b* can be more precisely aligned in terms of the direction parallel to the secondary scan direction. Therefore, the fourth embodiment can reduce an image forming apparatus in the amount of errors associated with the control sequence for aligning toner images. Further, in terms of the direction parallel to the secondary scan direction, this embodiment can more precisely align the points at which the electrostatic alignment code on the photosensitive drum 12 is read, and the points at which the electrostatic alignment code on the intermediary transfer belt 24 are read, in the downstream image formation stations. Therefore, it can reduce the errors associated with the control sequence for aligning toner images.

Further, even if the area on which the sensors 33*b* and 34*b* are present changes in position because of vibrations or the like, the point at which the electrostatic alignment code 31*b* is read, and the point at which the electrostatic alignment code 32 is read, are unlikely to become misaligned with each other in terms of the recording medium conveyance direction. Should they become misaligned, the amount of misalignment is insignificant compared to that in the third embodiment. Thus, this embodiment makes it possible to align toner images at a high level of accuracy.

<Embodiment 5>

Figure 27:
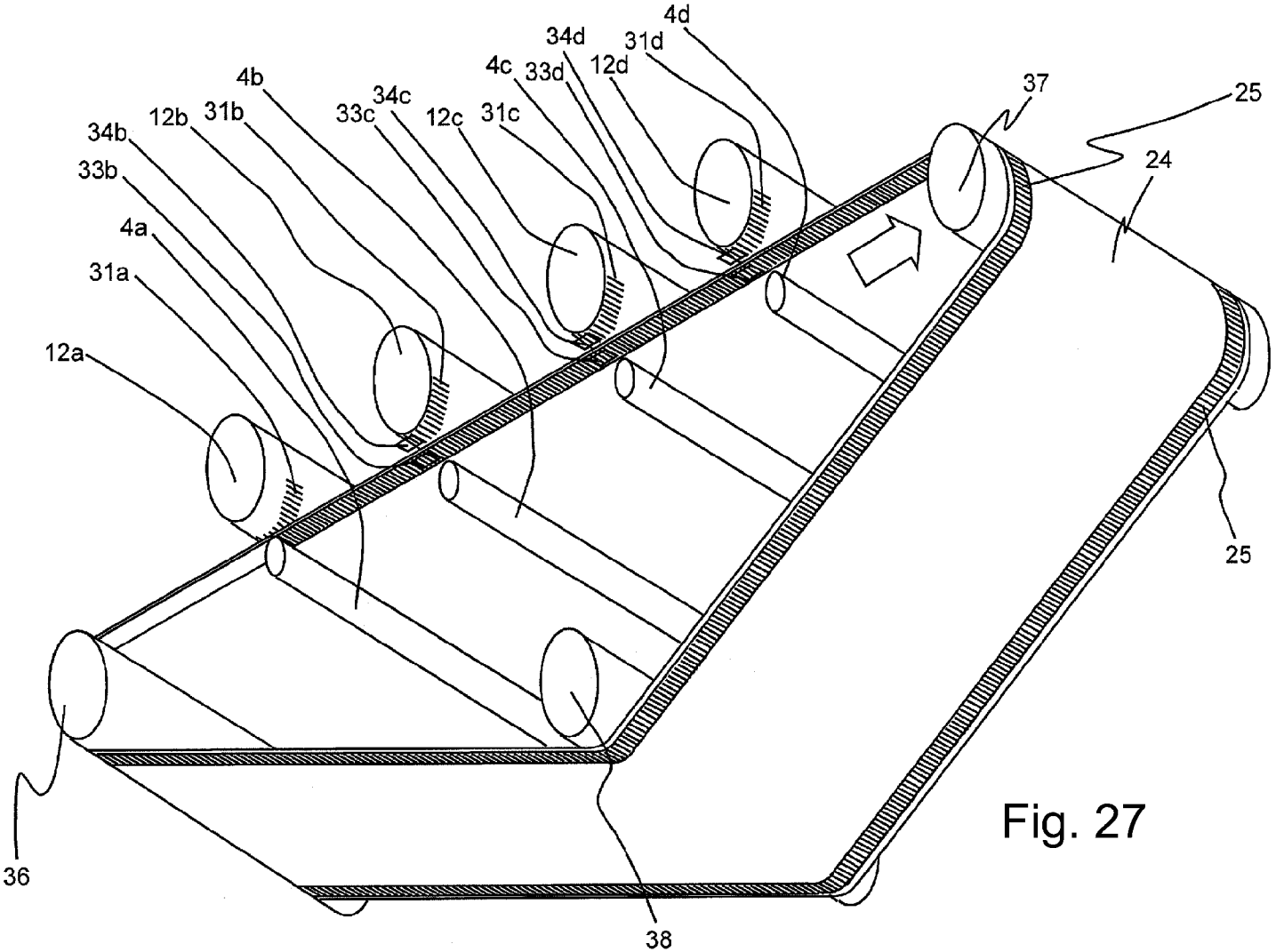
FIG. 27 is an illustration of an arrangement of an electrostatic image recording track and a potential sensor in Embodiment 5.

FIG. 27 is a drawing for describing the positioning of the electrostatic image recording track and potential sensors in the fifth preferred embodiment of the present invention.

Referring to FIG. 27, in the fifth embodiment, the transfer roller 47 for transferring an electrostatic code (bar code, for example) of the image forming station 43*a* is an integral part of the first transfer roller 4*a*. Otherwise, this embodiment is the same in the structure of an image forming apparatus as the third embodiment.

The structural arrangement for the image forming station 43 and intermediary transfer belt 24 in the fifth embodiment is for equalizing the transfer voltage for transferring the electrostatic alignment code 31*a* onto the electrostatic image recording track 25, with the transfer voltage for transferring a toner image from the photosensitive drum 12*a* onto the intermediary transfer belt 24, because as long as the two voltages are the same in specifications, it is unnecessary to provide the image forming apparatus 1 with two voltages sources which are different in specifications.

In the fifth embodiment, the transfer voltage has to be set so that it can satisfactorily transfer both a toner image and an electrostatic alignment code. This setup can be made by simply extending the first transfer roller 4*a*. Further, it is only one value that the transfer voltage is to be set. Therefore, the electrical power source may be simple in structure. Thus, the fifth embodiment makes it possible to provide an image forming apparatus which is significantly low in cost than the image forming apparatuses in the preceding embodiments.

<Embodiment 6>

Figure 28:
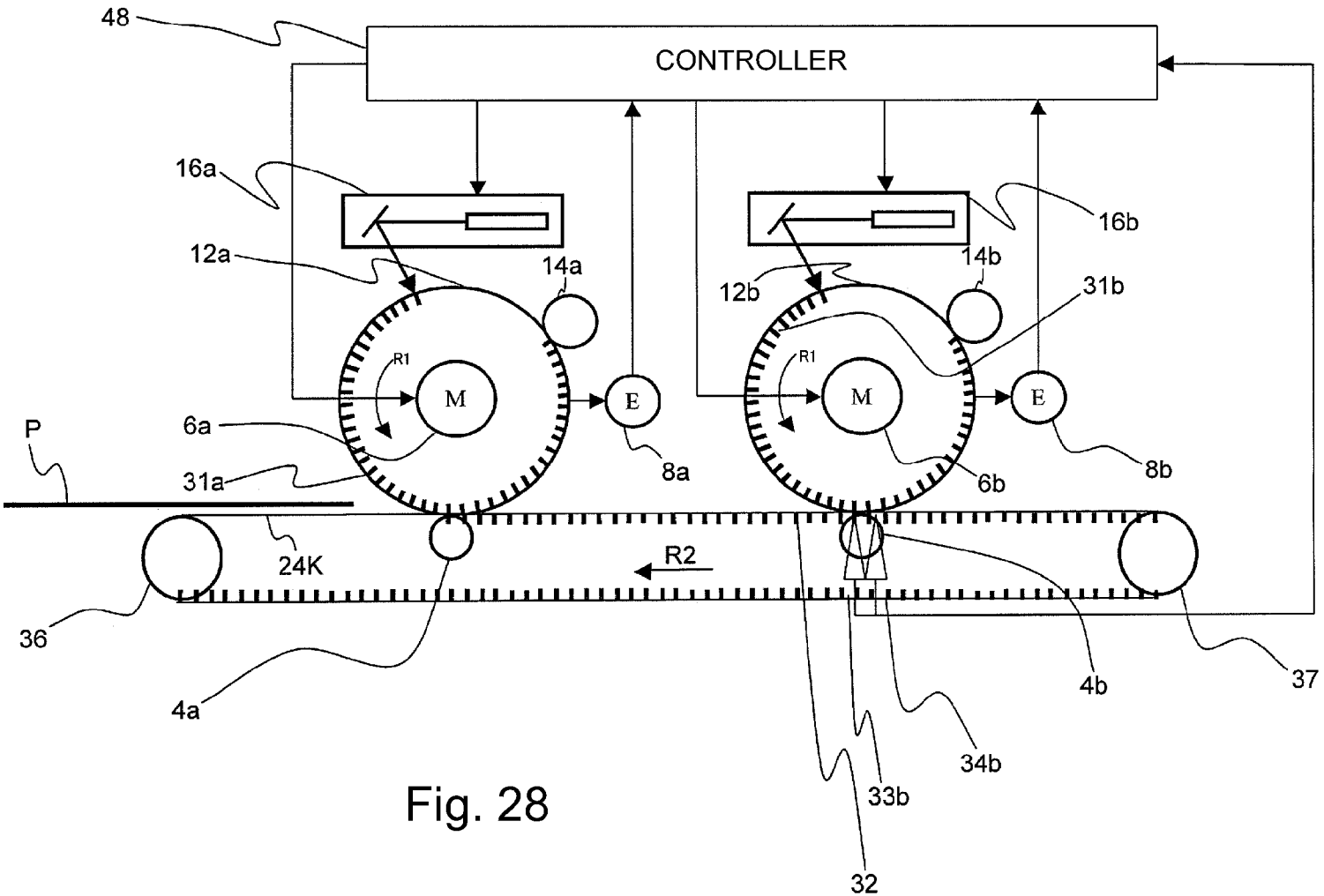
FIG. 28 is an illustration of an image forming apparatus using a recording material feeding belt.

FIG. 28 is a drawing for describing the image forming apparatus which has a belt for conveying a sheet P of recording medium instead of an intermediary transfer belt (24). The image forming apparatuses in the first to fifth embodiments employed an intermediary transfer belt. A control sequence similar to the control sequence executed by these image forming apparatuses in the preceding embodiments is usable for an image forming apparatus of the tandem type, which employs a recording medium conveying belt, which is an example of a recording medium conveying member.

Referring to FIG. 28, in an image forming apparatus 2, first, the toner image formed on the photosensitive drum 12*a* is transferred from the photosensitive drum 12*a* onto a sheet P of recording medium on a recording medium conveyance belt 24K, which is an example of a recording medium conveying member. Then, the toner image formed on the photosensitive drum 12*b* is transferred onto the sheet P on the recording medium conveyance belt 24K in such a manner that the toner image from the photosensitive drum 12*b* is layered onto the toner image on the sheet P on the belt 24K, in alignment with the toner image on the sheet P on the belt 24K. The control 48 momently controls the photosensitive drum 12*b* in rotational speed based on the outputs of the sensor 33*b* for reading the electrostatic alignment code on the recording medium conveyance belt 24K, and the outputs of the sensor 34*b* for reading the electrostatic alignment code on the photosensitive drum 12*b*.

Also in the case of the image forming apparatus 2 in the sixth embodiment, a control sequence similar to the control sequence carried out to align toner images in the first to fifth embodiments can be carried out by positioning the sensors 34*b*, 34*c*, and 34*d* for reading the electrostatic alignment code on the recording medium conveyance belt 24 in the image forming station 43*b*, 43*c*, and 43*d*, in the same manner as they are positioned in the first to fifth embodiments.

<Comparison of Art in Preceding Embodiment of Present Invention with Prior Art>

There is disclosed in Japanese Laid-open Patent Application Hei 10-39571, an art which aligns toner images by forming an electrostatic image on the most upstream photosensitive drum, transferring the electrostatic image onto an electrostatic image recording track formed of an electrically highly resistant substance, and conveying the transferred electrostatic latent image on the electrostatic image recording track to the downstream photosensitive drums.

This application, however, does not mention a structural arrangement which transfers an electrostatic image (bar code, for example) formed at a level of accuracy equivalent to the scanning line level of accuracy, onto an electrostatic image recording track, and causes the transferred electrostatic image on the electrostatic image recording track to reach the downstream drums, to detect the timing of the arrival of the electrostatic image at the downstream drums, at the scanning line level of accuracy.

There is disclosed in Japanese Laid-open Patent Application H10-293435, an art which forms an image (marks, such as bar code, for example), the resolution of which matches the scanning line resolution of the image to be formed on the photosensitive drum, on the most upstream photosensitive drum, and transfer the image (marks) onto the intermediary transfer belt, in order to use the image to control the downstream photosensitive drums in rotational speed.

This application, however, does not disclose a structural arrangement that transfers an electrostatic alignment code (bar code, for example), the resolution of which matches the scanning line resolution, onto an electrostatic image recording track, and causes the transferred electrostatic alignment codes (bar code, for example) on the electrostatic image recording track to reach the downstream photosensitive drums to detect the timing of the arrival of the electrostatic alignment codes at the downstream drums, at a level of accuracy which matches the scanning line resolution.

In comparison, the first to sixth embodiments of the present invention show that a control timing, the accuracy of which matches the scanning line resolution, can be obtained from the electrostatic alignment codes (bar code, for example) which are made to reach the downstream photosensitive drums, with the use of a potential sensor of the antenna type, such as the one shown in FIG. 7.

Further, these embodiments show that for the control accuracy, the potential sensors are desired to be positioned as shown in the first to fifth embodiments.

With the employment of the above described structural arrangements and control sequences, it is possible to provide a high speed electrophotographic color image forming apparatus of the tandem type, which is significantly less in color deviation (toner image misalignment), in particular, in terms of the recording medium conveyance direction, more specifically, no more than 20 μm (which matches high class printer) than any high speed electrophotographic color image forming apparatus of the tandem type, which is in accordance with the prior art.

Even in the case of a color image forming apparatus of the tandem type, which is provided with multiple image formation stations for higher speed, toner image alignment code can be formed on the most upstream photosensitive drum, in perfect alignment with the toner image on the photosensitive drum, by forming the toner image alignment code, in the form of an electrostatic alignment code, by the same exposure light as that which forms the electrostatic latent image on the photosensitive drum.

Further, according to these embodiments, electrostatic alignment codes are formed of electric charge, on the intermediary transfer belt (or recording medium conveyance belt), by forming electrostatic alignment code on the most upstream photosensitive drum, and transferring the electrostatic alignment code from the most upstream photosensitive drum onto the intermediary transfer belt at the same time as the toner image (developed electrostatic latent image) is transferred from the most upstream photosensitive drum onto the intermediary transfer belt. Therefore, it is possible to eliminate the errors which occur when the alignment code is written and/or read, and which are associated with a magnetic head, an optical head, a printing head, etc., that is, toner image alignment code writing means other than the means in the preceding means.

Further, the toner image aligning means in the preceding embodiments are not affected by the temperature fluctuation. Therefore, toner image alignment code can be formed on the intermediary transfer belt with the occurrence of no error in terms of the alignment between the toner image and electrostatic alignment code on the intermediary transfer belt when the toner image is transferred onto the intermediary transfer belt.

Further, in the most upstream image forming station, an electrostatic alignment code for aligning toner images is formed on the intermediary transfer belt so that there is no alignment error between the alignment code on the intermediary transfer belt and the toner image transferred onto the intermediary transfer belt from the most upstream photosensitive drum. Then, in the downstream image forming stations, the electrostatic alignment code on the intermediary transfer belt, and the electrostatic alignment code formed on the photosensitive drums with no alignment error between the alignment code and the toner image formed on the photosensitive drums one for one, are read. Then, the transfer lines across which the toner images are transferred onto the intermediary transfer belt are changed in position according to the reading of the electrostatic alignment code, while toner images are formed. Therefore, the toner images formed in the downstream image forming stations are layered onto the toner image formed in the most upstream image forming station, with as minuscule positional misalignment as possible, in the transfer areas in the downstream image forming stations. Therefore, it is possible to output high quality images, that is, images which are virtually free of color deviation.

Further, alignment codes are electrostatically formed on a photosensitive drum. Therefore, it is unnecessary to provide an image forming apparatus with writing means dedicated to the writing of alignment codes. Therefore, not only can an image forming apparatus be simplified in structure, but also, it can be reduced in the number of components to be adjusted. Therefore, it is possible to provide a full-color image forming apparatus which is substantially lower in cost than any full-color image forming apparatus in accordance with the prior art.

As described above, in the case of an image forming apparatus in accordance with the present invention, the first electrostatic alignment code is formed, in the first image forming station, on the first image bearing member of the apparatus in such a manner that its scanning lines strictly correspond to the scanning lines of an electrostatic image formed on the first image bearing member. Then, the electrostatic alignment code is transferred onto the electrostatic image recording track of the intermediary transfer member, and reaches the second image bearing member in the second image forming station. In the second image forming station, the second image bearing member is controlled so that the electrostatic alignment code formed on the second image bearing member aligns with the first electrostatic alignment code on the electrostatic image recording track. Therefore, it is momently and dynamically that the toner image on the second image bearing member are accurately positioned relative to the toner image (s) on the intermediary transfer belt, at a scanning line level of accuracy.

Further, the detecting means detects the electrical current induced in the electrically conductive member as the detecting means is moved relative to the electrostatic lines (bars). Therefore, even if the electrostatic lines (bars) are fine, being therefore minuscule in the amount of electrical charge, they are detected at a high SN ratio. Thus, the output of the detecting means is as highs in accuracy as the accuracy of scanning lines.

That is, the electrostatic image alignment code made up of fine electrostatic lines (bars) is read with the use of a potential sensor, and the results of the reading is used to align toner images on the intermediary transfer belt, or the sheet of recording medium on the recording medium conveying member, when the toner images are transferred onto the intermediary transfer belt or the sheet of recording medium on the recording medium conveying member. Therefore, the toner images are highly accurately layered on the intermediary transfer belt or the recording medium. Further, the detecting means can be structured so that it can reliably detect the electrostatic lines (bars) which make up the electrostatic alignment code. Therefore, the detecting means can be positioned as close as possible to the optimal position for detection.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 155743/2010 filed Jul. 8, 2010, which is hereby incorporated by reference.

What is claimed is:

1. An image forming apparatus comprising:

a first image bearing member;

first code forming means for forming a first electrostatic image code outside a developing zone for a toner image;

a second image bearing member;

second code forming means for forming a second electrostatic image code outside the developing zone for the toner image;

an intermediary transfer member provided with an electrostatic image recording track capable of holding the first electrostatic image code transferred from said first image bearing member to said second image bearing member;

transferring means for applying a voltage to a side of said intermediary transfer member which is opposite a side contactable to said first image bearing member to transfer the first electrostatic image code onto said electrostatic image recording track;

detecting means including an electroconductive member which is provided in parallel with said electrostatic image code and which is spaced from a surface of said electrostatic image code of the said electrostatic image recording track to be detected with a predetermined gap, and a detecting portion for detecting an induced current generated in said electroconductive member with relative movement relative to lines of said electrostatic image code, said detecting means detecting said first electrostatic image code of the said electrostatic image recording track and said second electrostatic image code of the said second image bearing member at a position of the said second image bearing member; and control means for controlling image formation on said first image bearing member or said second image bearing member on the basis of a detection result of the said detecting means such that the toner image on said second image bearing member is transferred onto said intermediary transfer member and overlaid on the toner image transferred onto said intermediary transfer member from said first image bearing member.

2. An apparatus according to claim 1, wherein said first electrostatic image code and said second electrostatic image code are in the form of incremental patterns with intervals corresponding to a predetermined number of scanning lines of the image, and said electroconductive member is fixed on a flexible insulative sheet material slidable on the surface to be detected.

3. An apparatus according to claim 1, wherein said electrostatic image recording track has a resistance which is higher than a resistance in a region onto which the toner image is transferred.

4. An apparatus according to claim 1, wherein said detecting means is disposed so as to detect said first electrostatic image code and said second electrostatic image code at a phase position where said intermediary transfer member and said second image bearing member contact with each other.

5. An apparatus according to claim 1, wherein said second electrostatic image code is written in a region outside said intermediary transfer member with respect to a longitudinal direction of the said second image bearing member, and said detecting means detects said first electrostatic image code at a side of said intermediary transfer member opposite a side which contacts said second image bearing member.

6. An apparatus according to claim 1, wherein said detecting means further includes an electroconductive member, and one of said electroconductive members detects said first electrostatic image code, and the other detects said second electrostatic image code, wherein said electroconductive members are provided on said insulative sheet material and are extended linearly interposing a groove of said insulative sheet material.

7. An apparatus according to claim 1, wherein said second electrostatic image code is written in a region outside said intermediary transfer member with respect to a longitudinal direction of the said second image bearing member, and said second image bearing member includes an annular portion for assuring a space between said electrostatic image recording track and said second image bearing member, wherein said detecting means detects said first electrostatic image code at said annular portion.

8. An apparatus according to claim 1, further comprising a first transfer roller for transferring a toner image from said first image bearing member onto an intermediary transfer member, wherein said transferring means includes a second transfer roller which is coaxial with said first transfer roller and which is supplied with a voltage different from a voltage applied to said first transfer roller.

9. An image forming apparatus comprising:

a first image bearing member;

first code forming means for forming a first electrostatic image code outside a developing zone for a toner image;

a second image bearing member;

second code forming means for forming a second electrostatic image code outside the developing zone for the toner image;

a transfer belt provided with an electrostatic image recording track capable of holding the first electrostatic image code transferred from said first image bearing member to said second image bearing member;

transferring means for applying a voltage to a side of said transfer belt which is opposite a side contactable to said first image bearing member to transfer the first electrostatic image code onto said electrostatic image recording track;

detecting means including an electroconductive member which is provided in parallel with said electrostatic image code and which is spaced from a surface of said electrostatic image code of the said electrostatic image recording track to be detected with a predetermined gap, and a detecting portion for detecting an induced current generated in said electroconductive member with relative movement relative to lines of said electrostatic image code, said detecting means detecting said first electrostatic image code of the said electrostatic image recording track and said second electrostatic image code of the said second image bearing member at a position of the said second image bearing member; and control means for controlling image formation on said first image bearing member or said second image bearing member on the basis of a detection result of the said detecting means such that the toner image on said second image bearing member is transferred onto a recording material on said transfer belt and overlaid on the toner image transferred onto the recording material from said first image bearing member.

10. An apparatus according to claim 9, wherein said first electrostatic image code and said second electrostatic image code are in the form of incremental patterns with intervals corresponding to a predetermined number of scanning lines of the image, and said electroconductive member is fixed on a flexible insulative sheet material slidable on the surface to be detected.

11. An apparatus according to claim 9, wherein said electrostatic image recording track has a resistance which is higher than a resistance in a region onto which the toner image is transferred.

12. An apparatus according to claim 9, wherein said detecting means is disposed so as to detect said first electrostatic image code and said second electrostatic image code at a phase position where said transfer belt and said second image bearing member contact with each other.

13. An apparatus according to claim 9, wherein said second electrostatic image code is written in a region outside said transfer belt with respect to a longitudinal direction of the said second image bearing member, and said detecting means detects said first electrostatic image code at a side of said transfer belt opposite a side which contacts said second image bearing member.

14. An apparatus according to claim 9, wherein said detecting means further includes an electroconductive member, and one of said electroconductive members detects said first electrostatic image code, and the other detects said second electrostatic image code, wherein said electroconductive members are provided on said insulative sheet material and are extended linearly interposing a groove of said insulative sheet material.

15. An apparatus according to claim 9, wherein said second electrostatic image code is written in a region outside said transfer belt with respect to a longitudinal direction of the said second image bearing member, and said second image bearing member includes an annular portion for assuring a space between said electrostatic image recording track and said second image bearing member, wherein said detecting means detects said first electrostatic image code at said annular portion.

16. An apparatus according to claim 9, further comprising a first transfer roller for transferring a toner image from said first image bearing member onto a transfer belt, wherein said transferring means includes a second transfer roller which is coaxial with said first transfer roller and which is supplied with a voltage different from a voltage applied to said first transfer roller.

* * * * *